US006137464A

United States Patent [19]

Inamori et al.

[11] Patent Number: 6,137,464

[45] Date of Patent: Oct. 24, 2000

[54] DISPLAY CONTROL CIRCUIT INCLUDING HARDWARE ELEMENTS FOR PREVENTING UNDESIRED DISPLAY WITHIN THE DISPLAY SPACE OF THE DISPLAY UNIT

[75] Inventors: Yoshimitsu Inamori, Nara; Koichi Oda, Sakai, both of Japan

[73] Assignee: Sharp Kabushiki Kaisha, Osaka, Japan

[21] Appl. No.: 08/445,867

[22] Filed: May 22, 1995

Related U.S. Application Data

[62] Division of application No. 08/191,723, Feb. 4, 1994, which is a continuation of application No. 07/743,608, Aug. 9, 1991, abandoned.

[30] Foreign Application Priority Data

| | | | |
|---|---|---|---|
| Aug. 10, 1990 | [JP] | Japan | P2-213165 |
| Aug. 10, 1990 | [JP] | Japan | P2-213167 |
| Aug. 10, 1990 | [JP] | Japan | P2-213169 |
| Aug. 25, 1990 | [JP] | Japan | P2-223350 |

[51] Int. Cl.[7] ..... G09G 3/36

[52] U.S. Cl. ..... 345/98

[58] Field of Search ..... 345/87, 92, 98, 345/99, 100, 103, 200, 201, 190, 193; 359/54, 56, 59

[56] References Cited

U.S. PATENT DOCUMENTS

| | | | |
|---|---|---|---|
| 4,985,698 | 1/1991 | Mano et al. | 345/103 |
| 5,387,922 | 2/1995 | Yun | 345/100 |
| 5,546,102 | 8/1996 | Scheffer et al. | 345/100 |

FOREIGN PATENT DOCUMENTS

| | | | |
|---|---|---|---|
| 2224873 | 5/1990 | United Kingdom | 345/98 |

*Primary Examiner*—Chanh Nguyen
*Attorney, Agent, or Firm*—Nixon & Vanderhye P.C.

[57] ABSTRACT

For display control of a liquid crystal display, display data and address signals for designating display dots are required. Segment address data designating X-direction addresses in the display space and common address data designating Y-direction addresses are input. Processing such as block transfer of address data in cases where the display address extends beyond the display space and where display picture is shifted within the display space has hitherto been carried out by software, but this places limitations on display speed. In the present application, the display space is divided in the X direction and the divisions of the display space are separately served by phural segment drive circuits. A common drive circuit is provided with hardware elements for selecting individual segment drive circuits so as to match the display address, This permits high-speed display operation and facilitates provision of software regulating the operation CPU.

10 Claims, 18 Drawing Sheets

Fig. 9

(1)

| DI7 | DI6 | DI5 | DI4 | DI3 | DI2 | DI1 | DI0 | DI7 | DI6 | DI5 | DI4 | DI3 | DI2 | DI1 | DI0 |
|---|---|---|---|---|---|---|---|---|---|---|---|---|---|---|---|
| 0 | 0 | 0 | 0 | 1 | 1 | 0 | 0 | 0 | 0 | 0 | 0 | 0 | 0 | 0 | 0 |
| AH | | | | | | | | AL | | | | | | | |

(2)

| XS | XE | X9 | X8 | X7 | X6 | X5 | X4 | X3 | X2 | X1 | X0 |
|---|---|---|---|---|---|---|---|---|---|---|---|
| 0 | 1 | 0 | 0 | 0 | 0 | 0 | 0 | 0 | 0 | 0 | 0 |

(3)

| D07 | D06 | D05 | D04 | D03 | D02 | D01 | D00 | D07 | D06 | D05 | D04 | D03 | D02 | D01 | D00 |
|---|---|---|---|---|---|---|---|---|---|---|---|---|---|---|---|
| 0 | 0 | 0 | 0 | 0 | 1 | 0 | 0 | 0 | 0 | 0 | 0 | 0 | 0 | 0 | 0 |
| AH | | | | | | | | AL | | | | | | | |

Fig. 11
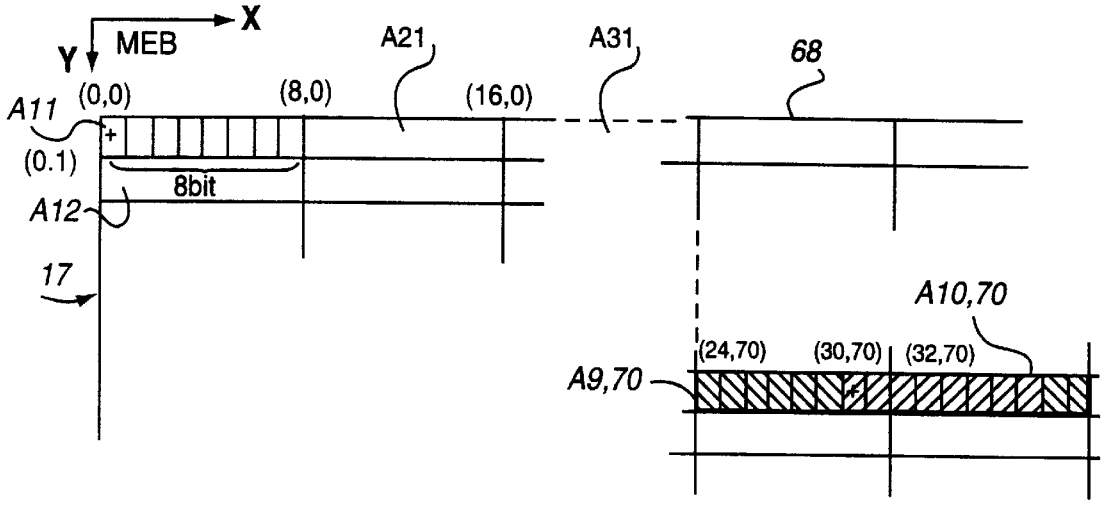
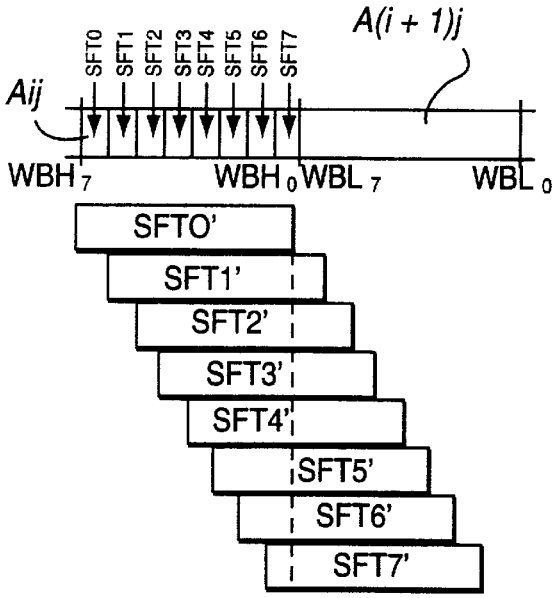
Fig. 13
Fig. 14
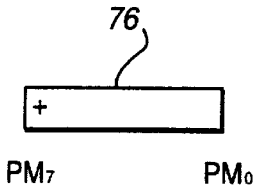

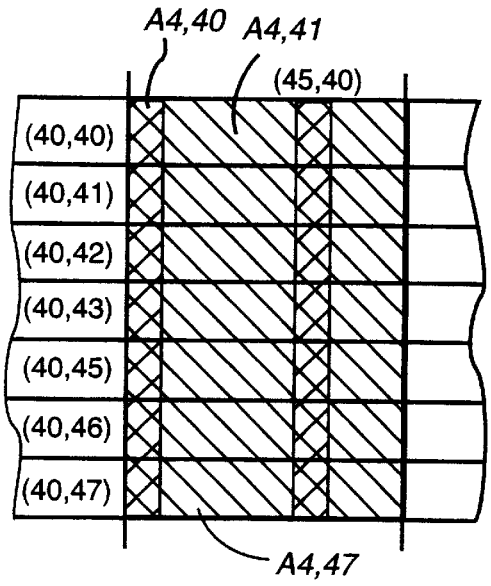
Fig. 15
Fig. 16
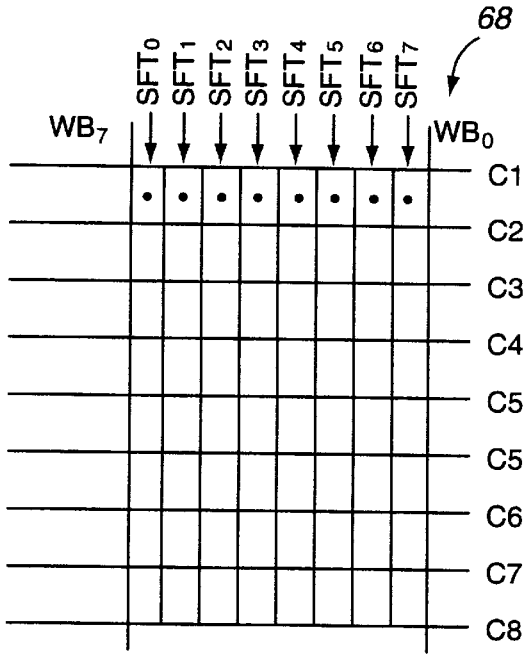
Fig. 17
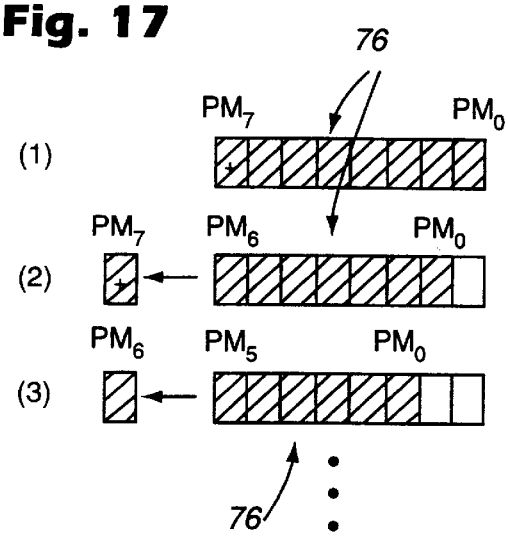

DISPLAY CONTROL CIRCUIT INCLUDING HARDWARE ELEMENTS FOR PREVENTING UNDESIRED DISPLAY WITHIN THE DISPLAY SPACE OF THE DISPLAY UNIT

This is a divisional of application Ser. No. 08/191,723, filed Feb. 4, 1994, which was in turn a continuation of Ser. No. 07/743,608, filed Aug. 9, 1991, now abandoned.

BACKGROUND OF THE INVENTION

1. Field of the Invention

The present invention relates to a display control circuit for controlling the display operation of a display unit, such as a liquid crystal display.

2. Description of the Prior Art

Liquid crystal display units are widely used as display units in, for example, Japanese word processors and computers. In such liquid crystal display units, the entire screen comprises a multiplicity of display pixels arranged in a matrix fashion, with separate addresses set for individual display pixels so that display can be performed by adjusting the display condition of display pixels for individual addresses.

FIG. 1 is a diagram showing a display space 101 in a prior art liquid crystal display unit or the like. The display space 101 has an effective addressing range of from minimum address (−1024, −512) at upper left corner to maximum address (1023, 511) at lower right corner, bit requirements for which there are 11 bits ($2^{10}$=1024, where the most significant bit is a sign bit) in X direction, and 10 bits ($2^{9}$=512, where the most significant bit is a sign bit) in Y direction.

A display control circuit 104 is connected to the liquid crystal display unit 101 in FIG. 1 through for example, an 8-bit address bus 102 and a data bus 103. Therefore, when the display control circuit 104 is to carry out display control of the liquid crystal display unit in order to cause the display pixel at a single address to perform a display operation, it is necessary that access in X direction be had two times as shown in FIG. 2 (1), say, to low-order address data AL and high-order address data AH, each consisting of 8-bit address data DI7 to DI0. similarly, access in Y direction must be had two times as shown in FIG. 2 (2).

It is noted that most significant bit DI7 in high-order address data AH is a sign bit. Therefore, in X direction, bits DI7,DI1, and DI0 of the high-order address data AH, and the low-order address data AL are effective data. In Y direction. as FIG. 2 (2) shows, bits DI7 and DI0 of the high-order address data AH, and the low-order address data AL are effective data.

When any error should occur with respect to address data input from the display control unit 104 to the liquid crystal display unit 101, some_undesired display may result within the effective address range of the liquid crystal display unit 101. When address data other than the effective address (1024, 512) shown In FIG. 1 are input to the liquid crystal display unit 101,

1024="0000010000000000"

which corresponds to the data configuration shown in FIG. 2 (1). In this case, bit DI2 of the high-order address data AH is outside the effective address range in the liquid crystal display unit. Therefore, the address (0, 0) in FIG, 1 is designated by the effective address. In other words, an undesired display occurs with respect to the pixel at the address. Examples of address data resulting in such undesired occurrence are shown in Table 1 below.

TABLE 1

| Designated address | Actual address |
|---|---|
| $400^{H}$ (1024) | $0^{H}$ |
| $800^{H}$ (2048) | $0^{H}$ |
| $1000^{H}$ (4096) | $0^{H}$ |
| $2000^{H}$ (8192) | $0^{H}$ |
| $4000^{H}$ (16384) | $0^{H}$ |
| $8000^{H}$ (32768) | $0^{H}$ |

In order to prevent occurrence of such undesired display, it has been usual practice to carry out software processing such that, where address data consist of, for example, bits smaller than a multiple of bits on the address bus 102, address data not within the scope of effective address are discriminated, when such data are input, so that no undesired display can occur within the effective display space. However, attempting to carry out such software processing each time when the display control circuit 104 accesses each individual address in the liquid crystal display unit 101 is very inconvenient in that such attempt results in decreased display efficiency. Further, inclusion of such processing functions involves a greater software burden.

For example, the case of a liquid crystal display unit of the simple matrix type is discussed. Such a display unit includes pluralities of belt-like transparent electrodes formed as row and column electrodes in intersecting relation on a pair of transparent bases, whereby matrix-form addresses are set in the entire display space of the liquid crystal display unit. A row drive circuit and a column drive circuit are connected to the liquid crystal display unit, and CPU (central processing circuit), for example, is connected to both the row drive circuit and the column drive circuit. The row drive circuit scans row electrodes in the liquid crystal display unit in the row or line-writing direction to longitudinally set address data, whereas the column drive circuit scans column electrodes in the column or column-writing direction to transversely set address data.

For the purpose of display by the liquid crystal display unit through such a display control circuit, segments are set for individual unit display spaces of 8 bits each, for example, in the line-writing direction in the display space, and access is had for each of the segments. Therefore, when display data of 8-bit each which extend over a plurality of unit display spaces are to be displayed, CPU processes address data by software and outputs processed address data to the row drive circuit. When display data are to be written in the display space for display by unit display spaces of 8-bit each, it is very difficult to process address data by software in both row and column directions, because such processing requires software containing extremely large amounts of programs.

In the foregoing prior art arrangement, processing of address data in CPU is carried out by software processing, and this involves a problem that CPU is excessively loaded. Another problem is that it is impracticable to achieve bidirectional display operation, or display operation in both the row direction and the column direction, which means that the utility of the prior art arrangement is rather limited.

FIG. 3 is a block diagram showing the arrangement of a typical prior-art display control circuit 104. The display control circuit 104 comprises a common drive circuit 105 for driving a common electrode of, for example, a liquid crystal display element 101 of the simple matrix type, segment drive circuits 106 for driving segment electrodes, and CPU (central processing unit) 107 for outputting address data and display data to the drive circuits 105, 106. The component circuits are interconnected by a bus line 108.

CPU107 comprises a write buffer 109 for retaining write data being written in predetermined addresses in the liquid crystal element 101, a read buffer 110 for storage of display data stored in the segment drive circuits 106, displayed by the liquid crystal display element 101 and read by CPU107, an arithmetic circuit 111 for carrying out one of plural kinds arithmetic operations with respect to data stored in the buffers 109, 110, and a result buffer 112 for retaining arithmetic operation results and transferring data to the segment drive circuits 106 at predetermined time intervals. Each of the buffers 109, 110, 112 has a capacity of, for example, 8 bits. It Is noted that symbol "." in FIG. 3 represents most significant bit (MSB) of the 8-bit data.

Next, the manner in which a write loop is executed for successively writing display data within a range of successive addresses in the liquid crystal display element 101 will be discussed.

Write address in which first display data is written is transferred from CPU107 to the segment drive circuit 106, and then display data are set in the write buffer 109 within CPU107. Then, predetermined arithmetic operation is carried out in the arithmetic circuit 111. The result is stored in the result buffer 112 and is then transferred to the segment drive circuit 106. Subsequently, similar processing is carried out with respect to each next successive write address.

That is, in the prior arrangement, when write instructions are to be successively executed over a range of successive addresses in the liquid crystal display element 101, It is necessary that write address be designated for each address. Also, it is necessary to follow a procedure such that the operation result in the result buffer 112 be temporarily saved in another place and, at a next write instruction, be read again for transfer to segment drive circuit 106. Such processing, when it is to be done by CPU107, is carried out through software processing, which is rather disadvantageous from the standpoint of time economy.

For execution of a loop for block transfer for reading display data from the segment drive circuit 106, read address for display data to be read is initially transferred from CPU107 to the segment drive circuit 106 and, in turn, read data for the address is transferred to CPU107 and is stored in the read buffer 110. A series of arithmetic operation is carried out with respect to the read data at the arithmetic circuit 111, and the operation results are stored in the result buffer 112. Write address is transferred to the segment drive circuit 106 according to same procedure as above stated, and display data is likewise transferred. Such block transfer makes it necessary to repeat the foregoing operation by software processing for each 8 bits. In this case, too, such a problem as stated above is involved.

As stated earlier, where display operation is carried out by software processing, there is involved considerable software burden, and the procedure for such processing is time-consuming, which makes it difficult to achieve high-speed display.

In liquid crystal display units of the type having a common electrode and segment electrodes formed respectively on a pair of transparent bases, with a liquid crystal layer interposed between the electrodes, addresses are set in a display space in a matrix fashion, for each of which addresses is carried out display control. To such a display unit having such display space set therein are connected a column address output circuit for outputting column address data, and a row address output circuit for outputting row address data. Where the display space in such a liquid crystal display unit is large-sized in the row direction, a plurality of row address output circuits are employed, and display control is carried out for each predetermined range of addresses. The row address output circuits and the column address output circuit are connected to a CPU (central processing circuit) including a microprocessor, etc. which supplies address data and display data to the address output circuits.

In such large-type liquid crystal display unit, CPU selects one of the plurality of row address output circuits according to each virtual display address in the display space, and the selected row address output circuit outputs actual address data within its scope of control. This process of operation is carried out by software through CPU. In the prior art, it has been necessary to carry out such software processing for each address in the display space. As such, the prior art practice of display processing has been time-consuming and, especially in the case of a portable data processing unit of the battery drive system, it has been difficult to supply such a comparatively large amount of power as is required for high-speed operation of CPU, which fact has made the foregoing problems all the more conspicuous.

SUMMARY OF THE INVENTION

It is an object of the invention to provide a display control circuit which eliminates the foregoing problems and can perform display control at higher speed.

It is another object of the invention to provide a display control circuit which eliminates the foregoing problems, can perform display operation with less software burden and at higher speed, and has better service properties.

It is another object of the invention to provide a display control circuit which eliminates the foregoing problems, can reduce software burden, and is capable of performing high-speed display operation.

It is another object of the invention to provide a display control circuit which eliminates the foregoing problems and can perform high-speed display operation.

The invention provides a display control circuit which causes display to be performed on a display means having a display space in which addresses are set, by supplying to the display means address data of a first number of bits corresponding to the display capacity of the display space, comprising:

data regulating means which receive the address data of the first number of bits and output address data of a second number of bits consisting of the first number of bits added with a predetermined number of extended bits, and which, when the address data of the first number of bits are outside the addresses in the display space, regulate the address data of the second number of bits within an addressing range outside the display space but based on the address data of the second number of bits, and outside-address detecting means for detecting the address data of the first number of bits if the address data is outside the addresses in the display space.

The invention provides a display control circuit comprising:

a plurality of row drive means connected to a display means having a display space in which addresses are set in a matrix fashion, being each provided for a predetermined addressing range extending in rows within the display space and being operative to output row address data within the addressing range and display data, and column drive means connected to both the row drive means and the display means for outputting column address data to the display means, being also operative to output a select signal for selecting one of the plurality of row drive means, row address data and display data, and control means for outputting display data and address data to the column drive means, the column drive means including a select signal generating means for outputting the select signal on the basis of address data input from the control means, and address data conversion means for outputting row address data for each row drive means on the basis of the address data.

The Invention a display control circuit comprising:

row drive means connected to a display means having a display space in which addresses are set in a matrix fashion, being operative to output row address data and display data, column drive means connected to both the display means and the row drive means for outputting column address data to the display means, being also operative to output to the row drive means a drive address data for regulating the row address data, and control means for outputting address data and display data to the column drive means, the column drive means including a operating means for carrying out arithmetic operation with respect to the display data received from the control means and the row drive means, a number data memory means for storing operation number data input from the control means, and display control data memory means for storing display control data on the display condition of the display data representing the result of arithmetic operation.

The invention provides a display control circuit comprising:

a plurality of one-direction address output means connected to a display means having a display space in which addresses are set in a matrix fashion, being operative to output one-direction address data for a predetermined address range.

other-direction address output means connected to the display means for outputting other-direction address data, being also operative to output a select signal for selecting one of the one-direction address output means, and address data for supply to the selected one-direction address output means, and control means for outputting to the other-direction address output means address data in the display space.

According to the invention, the display means having a display space in which addresses are set is supplied with address data of a first number of bits corresponding to the display capacity of the display space whereby display Is performed, and in this case the data regulating means which receive address data of the first number of bits output address date of a second number of bits consisting of the address data of the first number of bits added with a predetermined number of extended bits. For this purpose, when the address data of the first number of bits are outside the addresses in the display space, the address data of the second number of bits are regulated within an addressing range outside the display space but based on the address data of the second number of bits.

Such a function is performed by hardware in the form of circuitry and, therefore, regulation of the address data is carried out at a far much greater speed than in the case of such regulation being carried out by software. Thus, it is possible to prevent any such occurrence that an undesired display is made in the display space by address data outside the addresses in the display space. Since the regulation of the data is carried out by hardware, operation can be performed in far much more speedy manner than by software. Address data of the first number of bits are detected by the outside address data detecting means when the data are outside the addresses in the display space and, therefore, it is possible to easily and quickly detect any such inconvenient occurrence that address data of the first number of bits designate any address outside the addresses within the display space.

As stated above, according to the invention, when address data of the first number of bits are outside the addresses within the display space, address data of the second number of bits are regulated within an addressing range which is outside the display space but according to the address data of the second number of bits. Since such function is performed by hardware as a circuit, regulation of the address data is carried out much faster than by software. Thus, it is possible to avoid any such trouble that an undesired display is made in the display space by address data outside the addresses in the display space.

When address data of the first number of bits happen to be outside the addresses within the display space, such fact is detected by the outside address data detecting means and, therefore, occurrence of any such trouble that address data of the first number of bits designate other than addresses in the display space can be easily and quickly detected.

According to the invention, when making display in the display space of the display means, the control means output address data and display data to the column drive means. The column drive means select, on the basis of the address data, one of the plurality of row drive means connected through the select signal generating means to the display means. Further, the column drive means output, on the basis of address data from the control means, row address data for the selected row drive means and also output display data. The selected row drive means output row address data and display data to the display means, whereby display is performed.

Thus, according to the invention, the control means output address data and display data without processing address data output with respect to those within respective predetermined addressing ranges extending in the line-writing direction which are assigned to the plurality of row drive means, whereby display operation of the display means Is performed. Processing of address data for such display operation is carried out by hardware and, therefore, software burden for the display operation can be reduced. Accordingly, high-speed display operation can be successfully achieved. For the purpose of making transversely oriented display in the display space, same row drive means are selected for necessary number of column addressing ranges In succession, whereby, the required column display can be made. That is, display in the display space in line-writing and/or column-writing direction can be successfully performed, which provides for much improvement in serviceability.

As stated above, according to the invention, the control means output address data and display data without processing address data output with respect to those within respective predetermined addressing ranges extending in the line-writing direction which are assigned to the plurality of row drive means, whereby display operation of the display means is performed. Processing of address data for such display operation is carried out by hardware and, therefore, software burden for the display operation can be reduced. Accordingly, high-speed display operation can be successfully achieved. For the purpose of making transversely oriented display in the display space, same row drive means are selected for necessary number of column addressing ranges in succession, so that the required column display can be made. In other words, display in the display space in either the line-writing direction or column-writing direction, or both, can be successfully performed. This provides for much improvement in serviceability.

According to the invention, when making display on the display means in whose display space are set addresses in a matrix fashion, and over successive plural i ties of addresses, the control means output address data and display data to the column drive means. In the column drive means, arithmetic operation-number data from the control means are stored in the number data memory means, and display control data on the display condition of operation-result display data are stored in the display control data memory means. In the arithmetic operation means, on the basis of the operation number data stored in the number data memory means, arithmetic operation is carried out with respect to the display data from both the control means and the row drive means. The column drive means output the operation result, together with drive address data, to the row drive means, and output column addresses to the display means. Through this process is made display on the display means.

Such display processing over successive pluralities of addresses and a series of arithmetic operations involved in the display processing are carried out by hardware circuitry incorporated in the column drive means, and therefore the burden of the software which regulates the operation of the display control circuit is reduced and, in addition, display processing is carried out in much faster manner.

As stated above, according to the invention, display processing required over successive pluralities of addresses and a series of arithmetic operations involved in such processing are carried out by hardware means provided in the column drive means. Therefore, the burden of the software for regulating the operation of the display control circuit is reduced, and display processing can be performed much faster.

According to the invention. when making display on the display means in whose display space are set addresses in a matrix fashion, a plurality of one-direction address output means output one-direction address data for individual predetermined addressing ranges. Other-direction address output means receive address data on the display space from the control means. The other-direction address output means output other-direction address data to the display means, and also output a select signal for selecting one of the one-direction address output means, and address data to the selected one-direct address output means.

Therefore, as compared with the case in which such address processing is carried out by CPU as software processing, the invention can reduce the time requirement for display processing and achieve higher-speed processing for display operation.

As stated above, according to the invention, when address data on the display space are supplied from the control means to other-direction address output means, other-direction address data are output from the other-direction address output means to the display means and, in addition, a select signal for selecting one of the one-direction address output means, and address data for supply to the selected one-direction address output means are output.

Therefore, considerable reduction in time required for display processing can be achieved as compared with the case where such address processing is carried out by CPU as software processing, and high-speed processing in display operation is thus achievable.

BRIEF DESCRIPTION OF THE DRAWINGS

Other and further objects, features, and advantages of the invention will be more explicit from the following detailed description taken with reference to the drawings wherein:

FIGS. 9(1) to 9(3) are views illustrative of aspects of data conversion according to the embodiment;

FIG. 11 is a memory map of RAM68 in a segment drive circuit 17.

FIGS. 13 and 14 are views explanatory of the function of the embodiment;

FIGS. 15 to 17 are view explanatory of other functions of the embodiment;

DETAILED DESCRIPTION OF THE PREFERRED EMBODIMENTS

Figure 1:
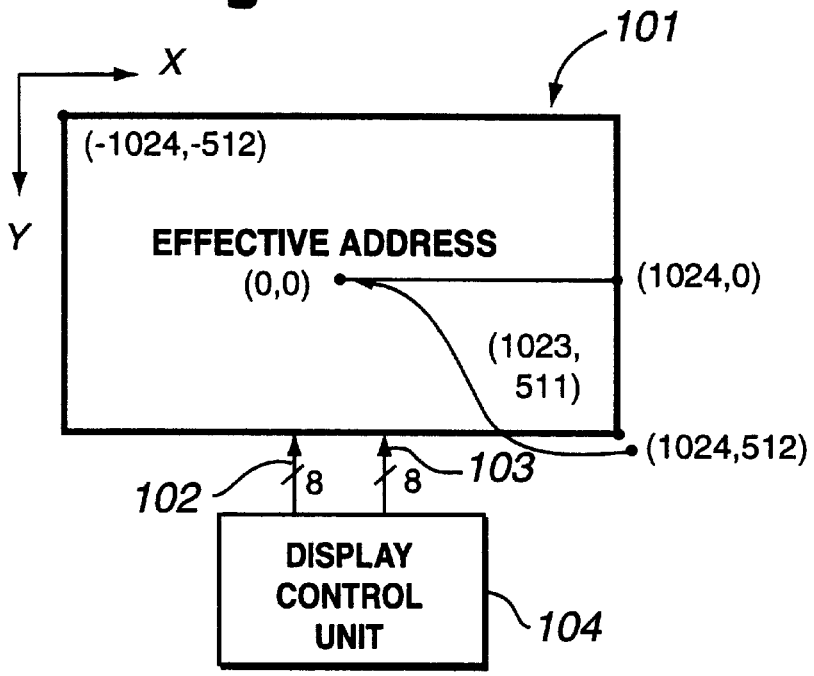
Fig. 1 Prior Art
FIG. 1 is a block diagram showing the arrangement of a prior art liquid crystal display unit 101.
Figure 2:
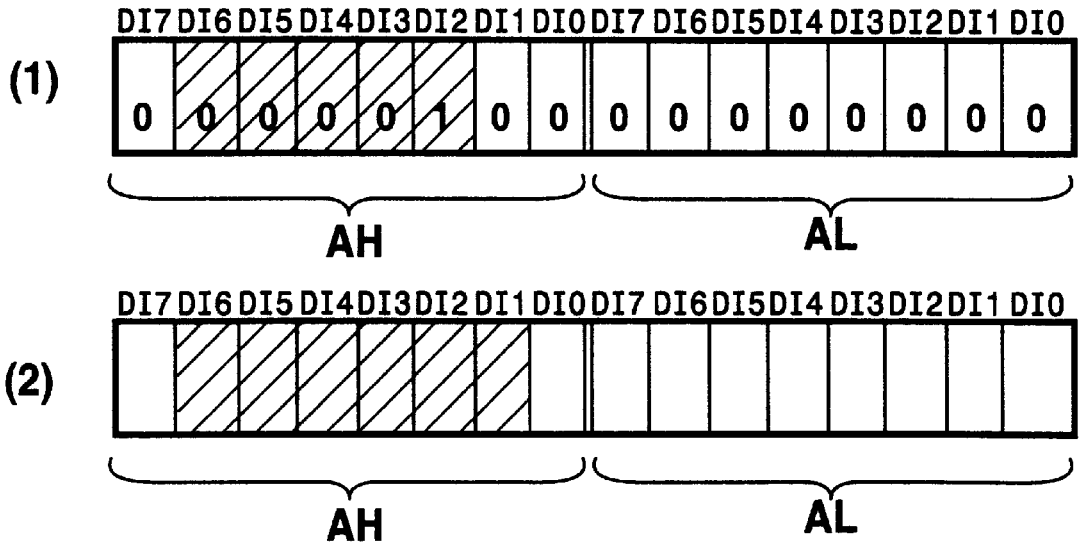
Fig. 2 Prior Art
FIG. 2(1) and 2(2) are views illustrative of data transfer in the prior art.
Figure 3:
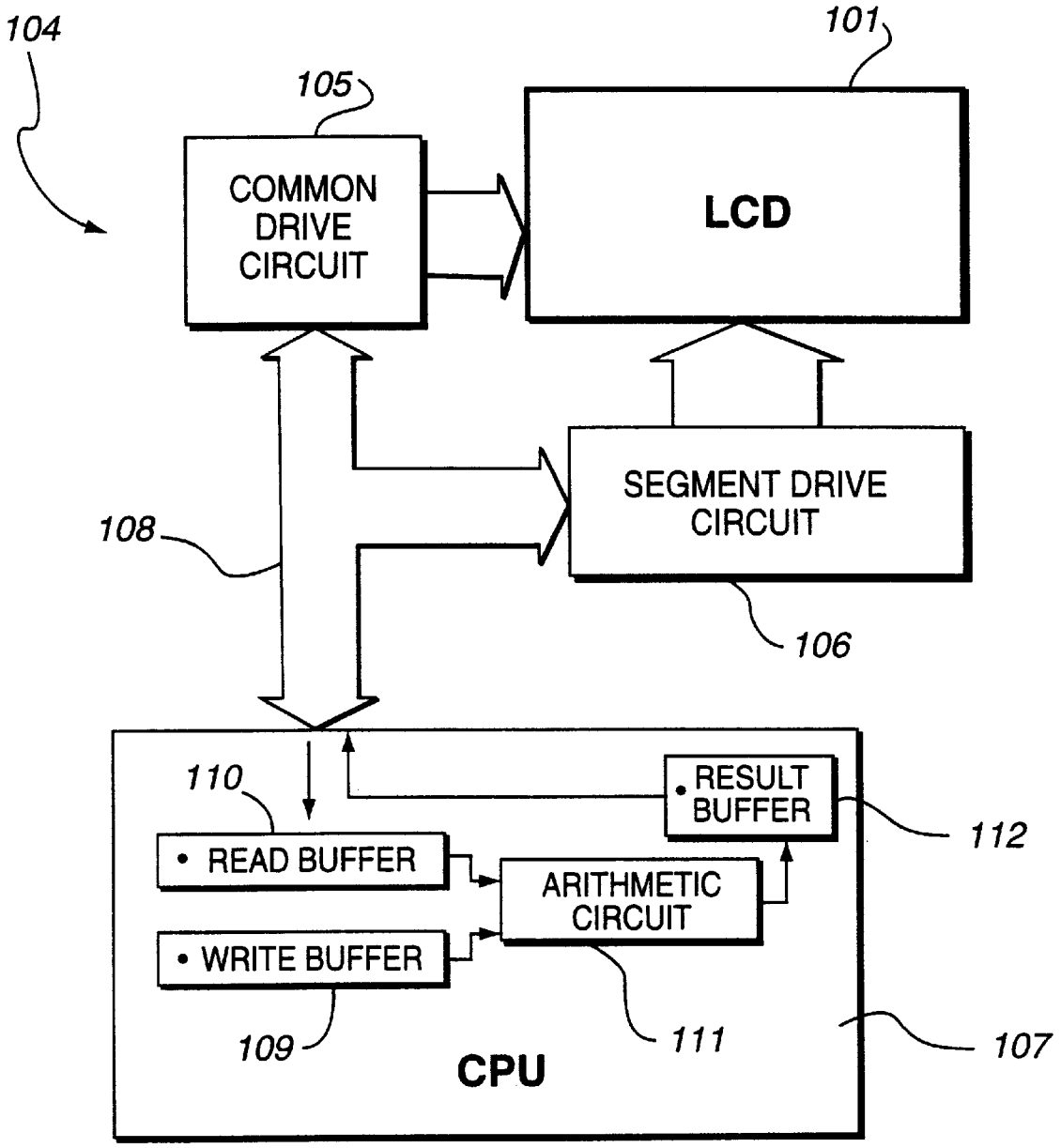
Fig. 3 Prior Art
FIG. 3 is a block diagram showing by way of example the arrangement of a typical prior art display control circuit 101.

Now referring to the drawings, preferred embodiments of the invention are described below.

Figure 4:
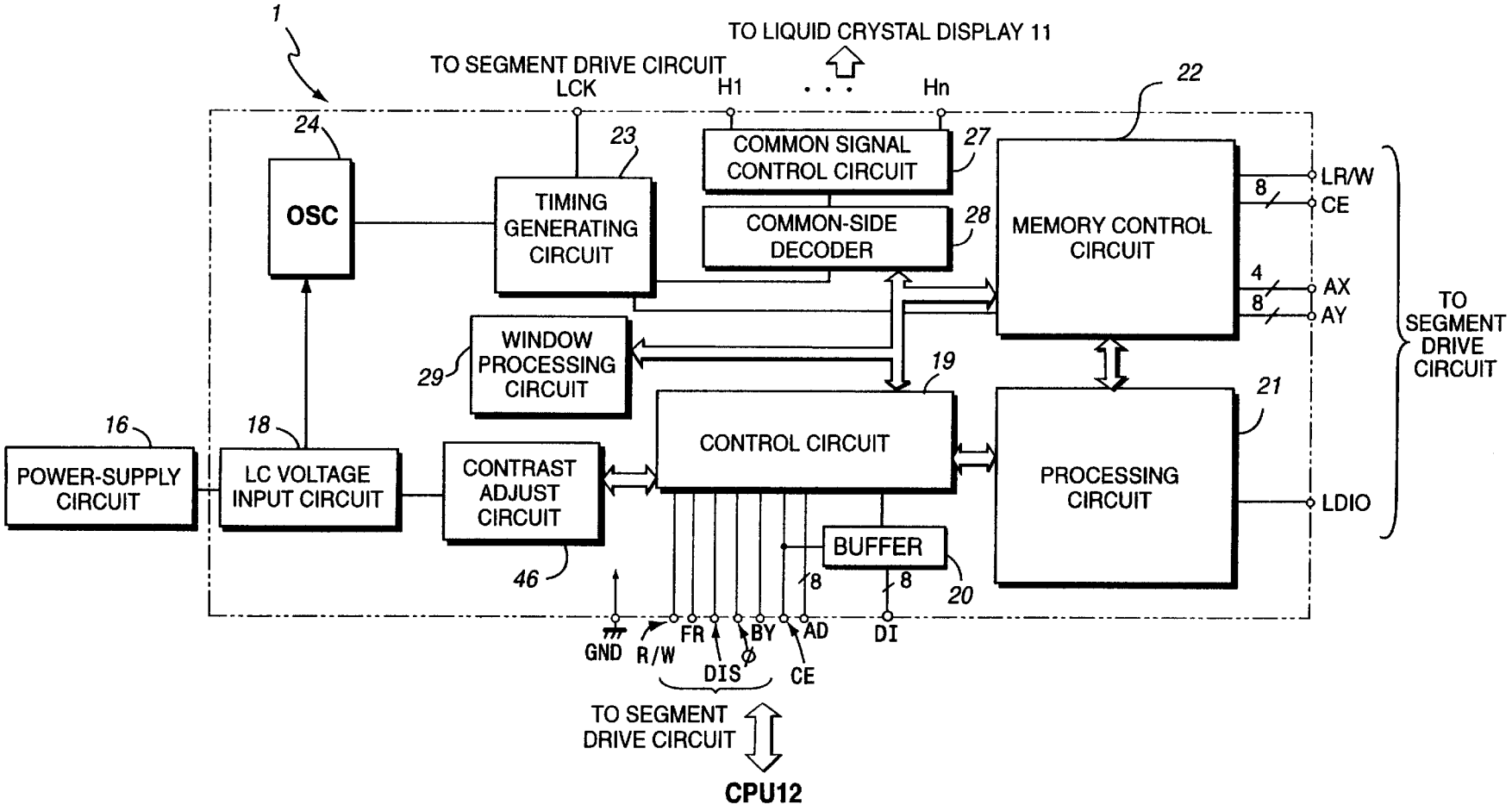
FIG. 4 is a block diagram showing a common drive circuit 1 according to one embodiment of the invention.
Figure 5:
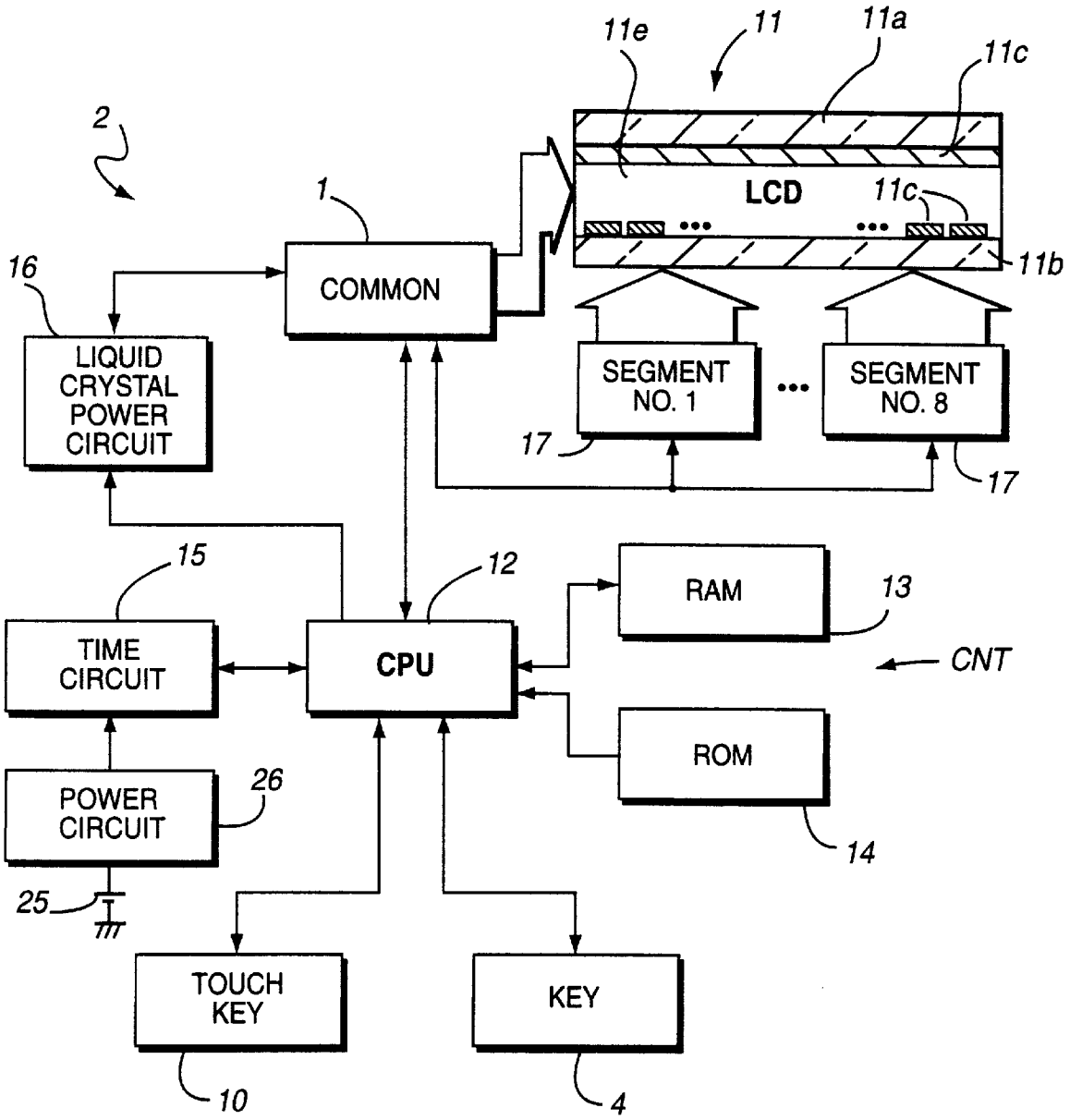
FIG. 5 is a block diagram showing a data processing unit 2.
Figure 6:
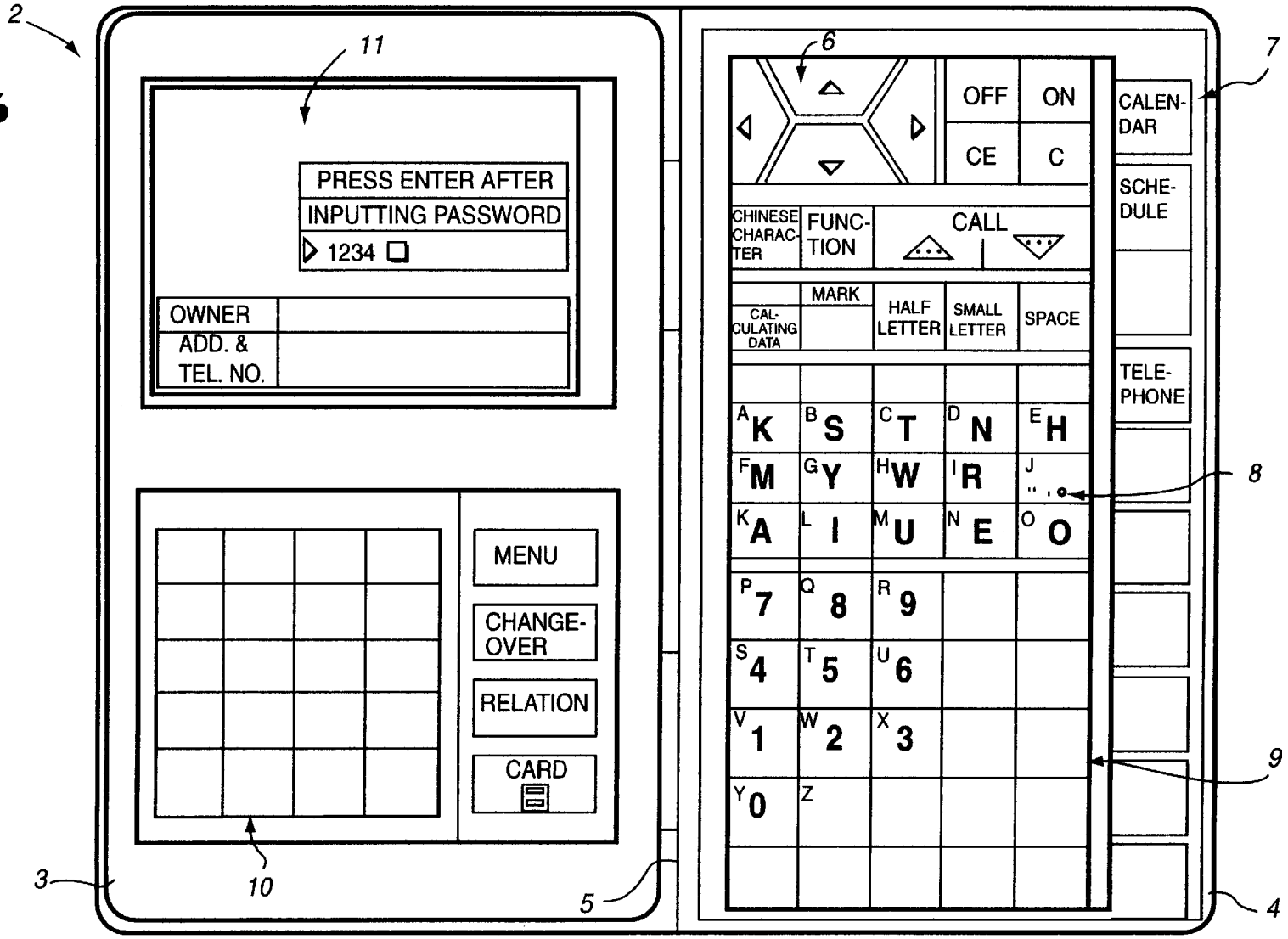
FIG. 6 is a plan view of the data processing unit 2.

FIG. 4 is a block diagram showing the arrangement of one embodiment of the invention; FIG. 5 is a block diagram of a data processing unit 2 in which a common drive circuit 1 is employed; and FIG. 6 is a plan view of the data processing unit 2. This data processing unit 2 is of a so-called pocket-book size and has a first control 3 and second control 4 which are adapted to be opened and a joint 5. At the second control 4 are arranged cursor keys 6, function setting keys 7, character input keys 8, and register keys 9, while at the first control 3 there are disposed so-called transparent touch keys 10 and a liquid crystal display unit 11.

Such a data processing unit 2 includes a display control circuit CNT in addition to the liquid crystal display unit 11. The display control circuit CNT has a CPU (central processing unit) 12 comprising, for example, a microprocessor to which are connected the transparent touch keys 10 and various key input means of the second control 4, and also RAM (random access memory) 13 to be used for storage of various kinds of input data and as a data working area during operation, and ROM (read only memory) 14 which stores a program for regulating control operation of CPU12, and display font data and calendar data.

Further, connected to CPU12 are a timer circuit 15 for clocking, a common drive circuit 1 for controlling display operation of the liquid crystal display unit 11 which will be described later, and a liquid crystal power supply circuit 16 which changes the potential of liquid crystal power supply for the common drive circuit 1 on the basis of a contrast signal from the common drive circuit 1 and which is on/off switchable in response to a control signal from CPU12. A plurality of segment drive circuits 17 (8 in number in this embodiment) are connected to the common drive circuit 1, the segment drive circuits 17 being operative to control display condition of the liquid crystal display unit 11, in conjunction with the common drive circuit 1. The liquid crystal display unit 11 comprises a common electrode 11*c* and segment electrodes 11*d* formed on a pair of transparent bases 11*a*, 11*b*, with a liquid crystal layer 11*e* interposed therebetween.

A block diagram of the common drive circuit 1 is shown in FIG. 4. The common drive circuit 1 includes a control circuit 19 to which are supplied from CPU12 various signals, such as write/read control signal R/W, clock signal ϕ, chip enable signal CE, and also address data AD and display data DI, from which busy signal showing the common driver state is output. Of these inputs, display data DI are input via a buffer 20. The common drive circuit 1 outputs frame signal FR, control signal DIS for on/off control of display by segment electrodes, and clock signal LCK to segment drive circuits 17. Such data processing unit 2 is of the portable type of pocketbook size, and various reference voltages required for operation of the data processing unit 2 are generated by a power supply circuit 26 connected to a battery 25.

Connected to the control circuit 19 is a data processing circuit 21 which carries out predetermined logical operations (such as SET, AND, OR, and XOR) with respect to address data and display data transferred from CPU12 and then transmits data to segment drive circuits 17. A memory control circuit 22 determines which one of the segment drive circuits 17 to which the address data sent from CPU12 is to be transferred and generates a relative address In the selected one of the segment drive circuits 17. A timing generating circuit 23 generates clock signals or the like for use in various arithmetic operations in the common drive circuit 1 and is supplied with a reference clock signal from an oscillator 24.

A common signal control circuit 27 and a common-side decoder 28 generates a common signal by using the clock signal generated at the timing generating circuit 23, which common signal is supplied to the common electrode of the liquid crystal display unit 11. A window processing circuit 29 having such configuration and function as will be described later is connected to the control circuit 19. A contrast adjust circuit 46 stores display density data with respect to the liquid crystal display unit 11, which density data is set by CPU12. Contrast adjustment at the liquid crystal display unit 11 is made in the liquid crystal power-supply circuit 16 shown in FIG. 5 on the basis of the density data in a contrast adjust circuit 46. There Is provided a liquid crystal voltage input 18 for fetching Into the common drive circuit 1 a liquid crystal power-supply potential from the liquid crystal power-supply circuit 16.

Figure 7:
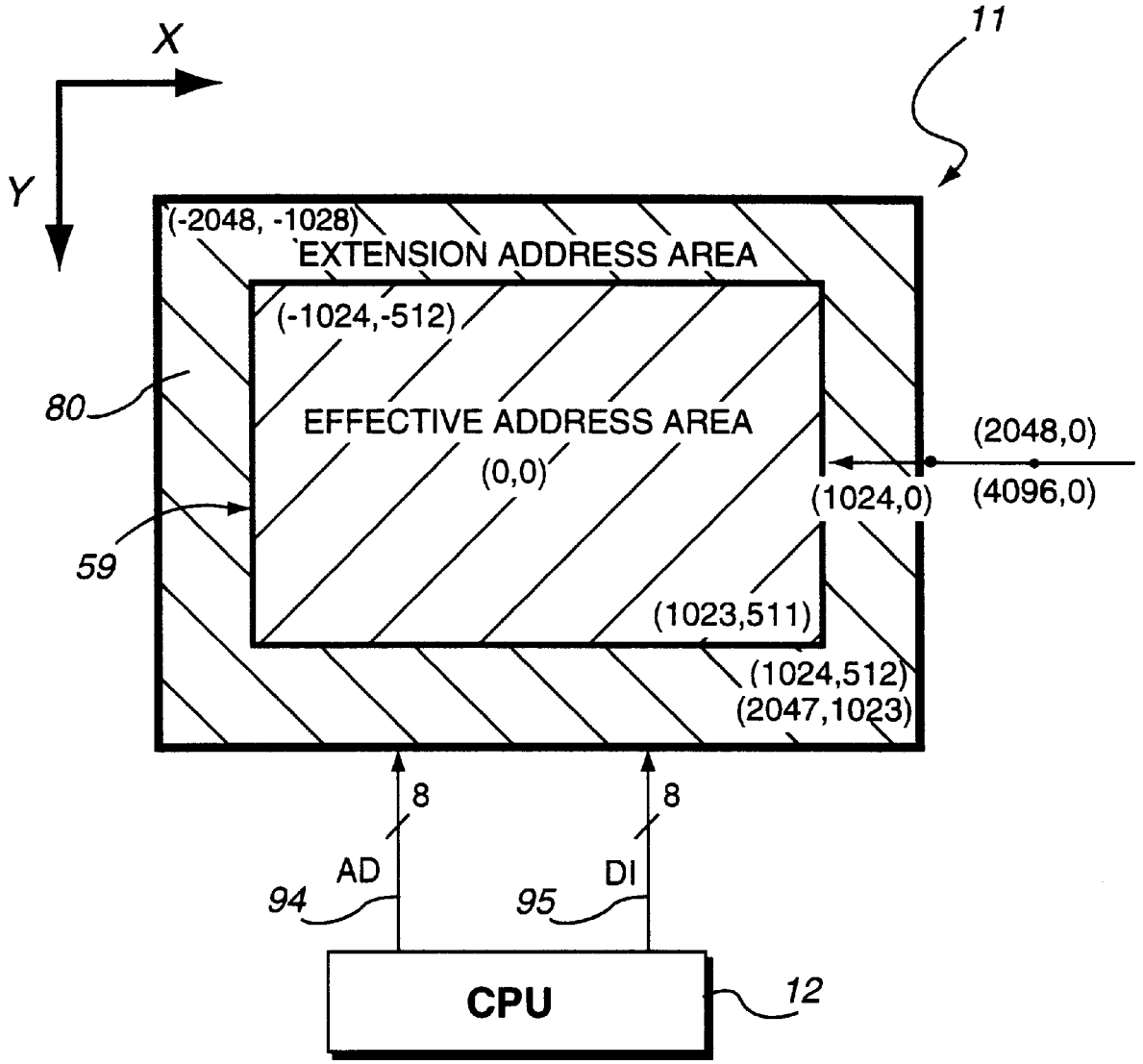
FIG. 7 is a view showing a display space 59 and an extended addressing range 80 according to the embodiment.

FIG. 7 is a view showing a display space 59 in the liquid crystal display unit 11. The display space 59 has an effective address range extending from minimum address (−1024, −512) at upper left corner to maximum address (1023, 511) at lower right corner the, necessary number of bits for which is 11 bits in X direction ($2^{10}$=1024, where the most significant bit is sign bit) and 10 bits in the Y direction ($2^{9}$=512, where the most significant bit is sign bit).

As FIG. 7 shows, CPU12 is connected to the liquid crystal display unit 11 via an 8-bit address bus 94 and a data bus 96. Therefore, when CPU12 is to cause the display pixel at a single address to perform a display operation in carrying out display control of the liquid crystal display unit 11, it is necessary that access be had two times in X direction, say, one time each with respect to low-order address data AL and high-order address data AH, both consisting of 8-bit address data DI7 to DI0, as shown in FIG. 9. Likewise, with respect to Y-direction address, access must be had two times, as shown in FIG. 9 (2).

It is noted that most significant bit DI7 of high-order address data AH is a sign bit. Therefore, in X direction address data, bits DI7, DI1, DI0 of the high-order address data AH and all bits of the lower address data are effective data. With respect to Y direction address data, as shown in FIG. 9(3) bits DO7, DO0 of the high-order address AH and all bits of the low-order address data AL are effective data.

In the case that any error should occur with address data input from CPU12 to the liquid crystal display unit 11, an undesired display may occur within the effective address range in the liquid crystal display unit 11. For example, address value (3072, 512) outside the effective address shown in FIG. 7 Is input to the liquid crystal display unit 11, 1024="0000010000000000", in which case the data configuration is as shown in FIG. 9 (1).

In this case, bit DI2 of high-order address data AH is outside the effective address range in the liquid crystal display unit 11, and therefore the effective address data designates address (0, 0) as shown in FIG. 7. Accordingly, an undesired display is made with respect to the pixel of the address. Exemplary cases of such undesired occurrence are as shown In Table 1 earlier.

In this embodiment, the 11 bit address defining the display space 59 extended by 1 bit in X direction for 12-bit address data setting. Also, the effective address of 10 bits corresponding to the display space 59 is extended by 1 bit for 11 bit data setting. In other words, an extended address range 80 is set in a peripheral area of the display space 54. In the embodiment, it is intended that where high-order address data AH and low-order address data AL, each of 8 bits, are address data extending beyond the addressing range of the display space 59 as shown in FIG. 9 (1), the address data, whatever it may be, is to be regulated within the extended addressing range 80.

Figure 8:
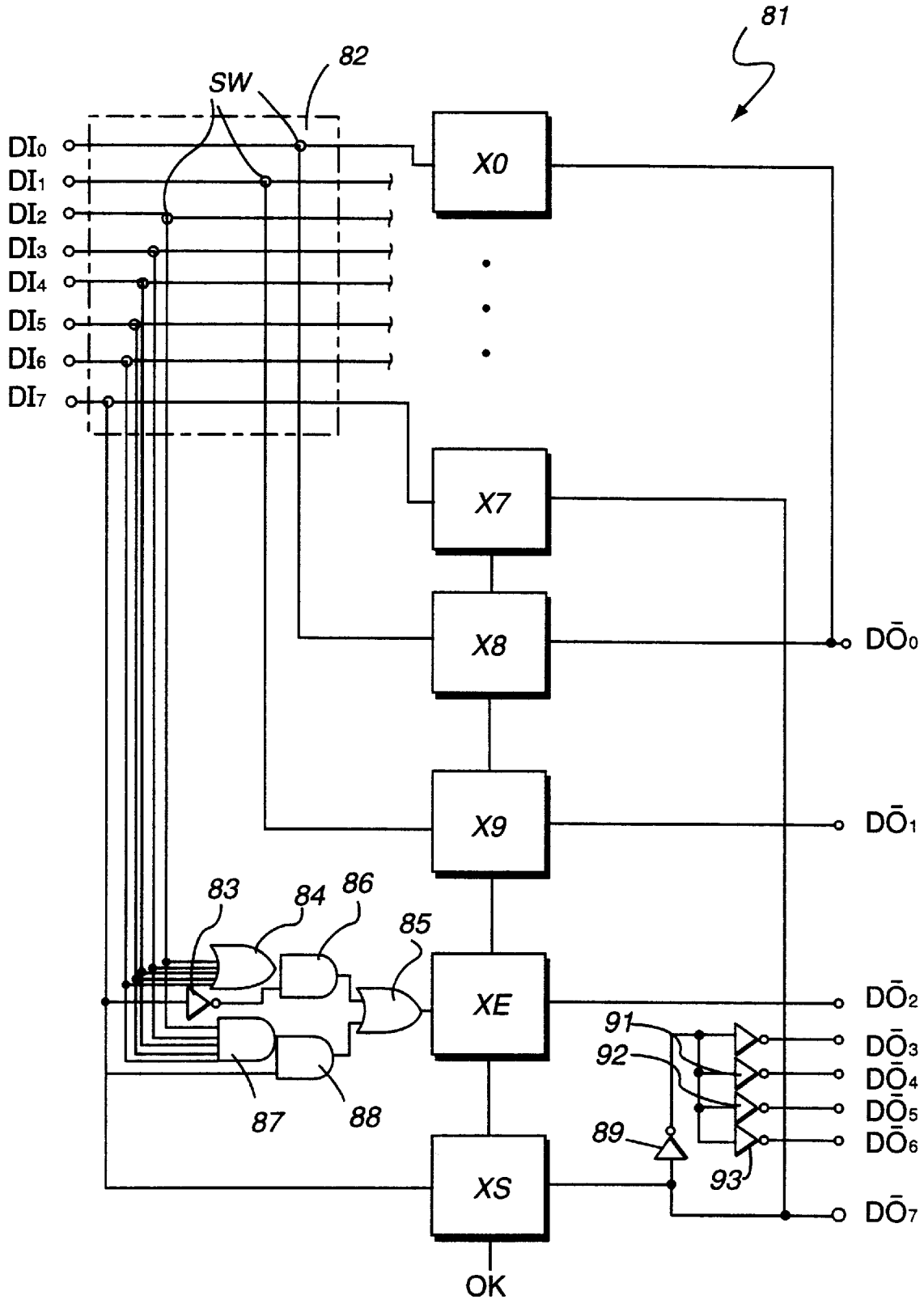
FIG. 8 is a block diagram showing a data conversion circuit 81 of the embodiment.

FIG. 8 is a block diagram of a data conversion circuit 81 provided in the memory control circuit 22 for data conversion. The data conversion circuit 81 is employed in processing X-direction address data shown in FIG. 7 and is designed to process high-order and low-order address data AH and AL shown in FIG. 9 (1). The data conversion circuit 81 Is provided with 12 registers X0, . . . X9, XE, XS. Input data DI7 to DI0 are connected by switching elements SW to registers X0 to X7, if the data are low-order address data AL, and to registers X8, X9, XE, XS if the data are high-order data, as will be hereinafter described.

In this case, an inversion circuit 83, two OR circuits 84, 85, and three AND circuits 86, 87, 88 carry out arithmetic operations with respect to data DI7 and DI0, according to the following equations 1 to 12.

$$X0 = DI0 * \delta 1 \quad (1)$$

$$X1 = DI1 * \delta 1 \quad (2)$$

$$X2 = DI2 * \delta 1 \quad (3)$$

$$X3 = DI3 * \delta 1 \quad (4)$$

$$X4 = DI4 * \delta 1 \quad (5)$$

$$X5 = DI5 * \delta 1 \quad (6)$$

$$X6 = DI6 * \delta 1 \quad (7)$$

$$X7 = DI7 * \delta 1 \quad (8)$$

$$X8 = DI0 * \delta 2 \quad (9)$$

$$X9 = DI1 * \delta 2 \quad (10)$$

$$XE = \{\overline{DI7} * (DI2 + DI3 + DI4 + DI5 + DI6) + DI7 * (DI2 \cdot DI3 \cdot DI4 \cdot DI5 \cdot DI6)\} * \delta 2 \quad (11)$$

$$XS = DI7 * \delta 2 \quad (12)$$

In the above equations, symbol δ 1 is effective when the symbol immediately preceding same (e.g., DI0) Is for lower 8-bit accessing, symbol δ 2 is effective when the symbol immediately preceding same (e.g., entire right side in equation 11) is for high-order address data AH accessing. There are provided five inversion circuits 89 to 93 with respect to the output of register XS to give outputs DO7 to DO0.

For processing Y-direction address data, a circuitry similar to that shown in FIG. 8 block diagram is provided to perform arithmetic operations according to the following equations 13 to 23.

$$Y0 = DI0 * \delta 1 \quad (13)$$

$$Y1 = DI1 * \delta 1 \quad (14)$$

$$Y2 = DI2 * \delta 1 \quad (15)$$

$$Y3 = DI3 * \delta 1 \quad (16)$$

$$Y4 = DI4 * \delta 1 \quad (17)$$

$$Y5 = DI5 * \delta 1 \quad (18)$$

$$Y6 = DI6 * \delta 1 \quad (19)$$

$$Y7 = DI7 * \delta 1 \quad (20)$$

$$Y8 = DI0 * \delta 2 \quad (21)$$

$$YE = \{\overline{DI7} * (DI1 + DI2 + DI3 + DI4 + DI5 + DI6) + DI7 * (DI1 * DI2 * DI3 * DI4 * DI5 * DI6)\} * \delta 2 \quad (22)$$

$$YS = DI7 * \delta 2 \quad (23)$$

In Y direction, as well, processing similar to that with X-direction address data is carried out, so that when any data indicative of an address range outside the display space 59 is input, the address designated by such incorrect data is regulated within an extended address range 80 shown in FIG. 7, One example of such case is explained with reference to FIG. 9.

FIG. 9 (1) shows a case in which x-direction address= 3072 is designated by incorrect address data. Arithmetic operations as described above are carried out with respect to the input and, as a result, data shown in FIG. 9 (2) is stored in registers X0 to X9, XE, XS. High-order address data AH and low-order address data AL input to the liquid crystal display unit 11 on the basis of the stored data are as shown in FIG. 9 (3). The data indicate $2^{10}$=1024, and from this it can be understood that X-direction address=3024 is regulated within the extended address range 80. Examples of such processing are given in Table 2 below.

TABLE 2

| Designated address | Actual address |
|---|---|
| $400^H$ (1024) | $400^H$ (1024) |
| $800^H$ (2048) | $400^H$ (1024) |
| $1000^H$ (4096) | $400^H$ (1024) |
| $2000^H$ (8192) | $400^H$ (1024) |
| $4000^H$ (16384) | $400^H$ (1024) |
| $8000^H$ (32768) | $400^H$ (1024) |

When the contents of storage in the individual registers X0 to X9, XE, XS are to be transferred as read data to CPU12, X-direction output data DO7 to DO0 are expressed by the following equations 24 to 31.

$$DO0 = X0 * \delta 1 + X8 * \delta 2 \quad (24)$$

$$DO1 = X1 * \delta 1 + X9 * \delta 2 \quad (25)$$

$$DO2 = X2 * \delta 1 + XE * \delta 2 \quad (26)$$

$$DO3 = X3 * \delta 1 + XS * \delta 2 \quad (27)$$

$$DO4 = X4 * \delta 1 + XS * \delta 2 \quad (28)$$

$$DO5 = X5 * \delta 1 + XS * \delta 2 \quad (29)$$

$$DO6 = X6 * \delta 1 + XS * \delta 2 \quad (30)$$

$$DO7 = X7 * \delta 1 + XS * \delta 2 \quad (31)$$

Symbols δ 1, δ 2 have same meaning as earlier explained. Transfer of data to CPU12 is carried out two times, 8 bits each time. Far Y-direction data, output data DO7 to DO8 expressed by the following equations 32 to 39 are obtained.

$$DO0 = Y0 * \delta 1 + Y8 * \delta 2 \quad (32)$$

$$DO1 = Y1 * \delta 1 + YE * \delta 2 \quad (33)$$

$$DO2 = Y2 * \delta 1 + YS * \delta 2 \quad (34)$$

$$DO3 = Y3 * \delta 1 + YS * \delta 2 \quad (35)$$

$$DO4 = Y4 * \delta 1 + YS * \delta 2 \quad (36)$$

$$DO5 = Y5 * \delta 1 + YS * \delta 2 \quad (37)$$

$$DO6 = Y6 * \delta 1 + YS * \delta 2 \quad (38)$$

$$DO7 = Y7 * \delta 1 + YS * \delta 2 \quad (39)$$

In this embodiment, as above described, where address data input to the liquid crystal display unit 11 from CPU12 are outside the display space 59, the data designated by incorrect data are regulated by a circuit of the configuration shown in FIG. 8 so that the data are within the extended addressing range 80 which is outside the display area 59. By virtue of this arrangement it is possible to prevent the occurrence of any undesired display within the display space 59 because of incorrect address data. Since such processing is carried out by hardware, higher-speed display processing can be realized.

In the foregoing embodiment, it is arranged that where high-order address data AH and low-order address data AL shown in FIG. 9 designate an address outside the display space 59, the register XE shown in FIG. 8 registers "1". Therefore, by reading the content of storage in the register XE it is possible for CPU12 to readily detect whether or not incorrect address data has occurred.

Next, a data processing unit 2*a* representing a second embodiment of the invention will be described. The data processing unit 2*a* is of same arrangement as the foregoing embodiment shown in FIGS. 4 to 6, and therefore detailed description of the arrangement is omitted.

Figure 10:
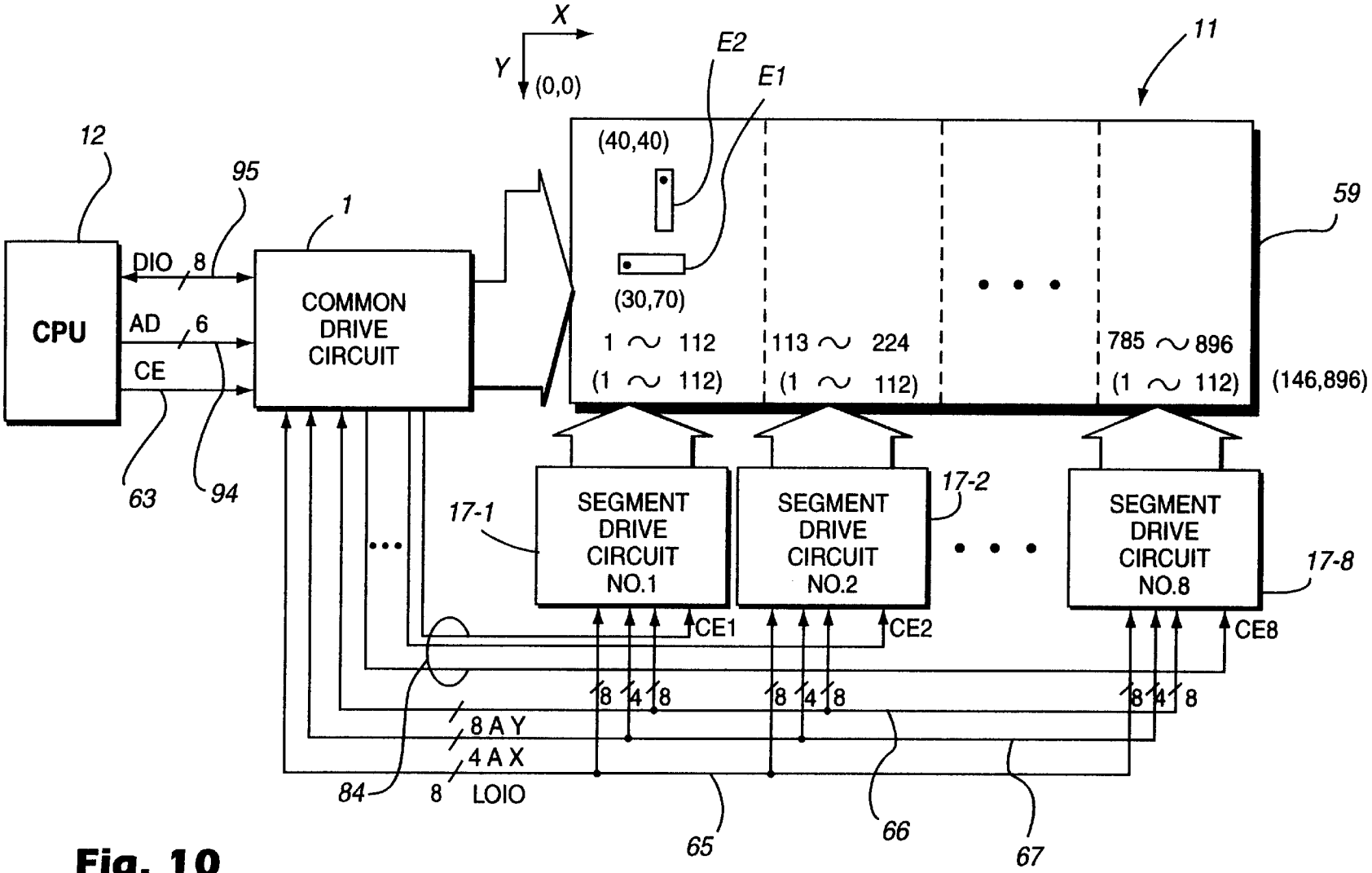
FIG. 10 is a block diagram illustrating a wiring configuration associated with a liquid crystal display unit 11.

FIG. 10 is a block diagram showing an arrangement related to address control operation of the data processing unit 2*a*. An 8-bit data bus 95, a 6-bit address bus 94, and a control line 63 through which a select signal CE for selecting the common drive circuit 1 is output are provided between CPU12 and the common drive circuit 1. Between the common drive circuit 1 and individual segment drive circuits 17-1 to 17-8 there are provided eight control lines 84 which are individually connected to the segment drive circuits 17-1 to 17-8 and through which select signals CE1 to CE8 for selecting one of the segment drive circuits 17-1 to 17-8 are output, an 8-bit data bus 65, an address bus 66 which supplies 8-bit address data AY on Y-direction addresses in the liquid crystal display unit 11, and an address bus 67 which supplied 4-bit address data AX on X-direction addresses.

The liquid crystal display unit 11 in this embodiment has a virtual address space set therein which has virtual addresses ranging from address (0, 0) at upper left corner to address (146, 896) at lower right corner. The segment drive circuits 17-1 to 17-8 are disposed for each predetermined address range (of, for example, 112 bits) extending in the line-writing direction in the liquid crystal display unit 11. That is, segment drive circuit 17-1 covers a row address range of 1 to 112; and segment drive circuit 17-2 covers a row address range of 113 to 224; and similarly segment drive circuit 17-8 covers a row address range of 785 to 896.

In this embodiment, when display data are to be written In the liquid crystal display unit 11, in the case of horizontal writing, such data are written over a range of successive 8 bits extending from write start address in the line-writing direction as shown at area E1 In FIG. 10, and in the case of columnar writing as will be described later, display data are written over a range of successive 8 bits extending from display start address in the column-writing direction as shown at area E2.

FIG. 11 is a view showing the arrangement of segment drive circuit 17. The segment drive circuits 17-1 to 17-8 each comprises RAM68 in which display data transferred via data bus 65 are written in units of 8 bits from a write start address designated by address data AX, AY from the address bus 66, 67 in the line writing direction. Each RAM68 has an address range corresponding, for example, to the address range (0, 0) to (146, 112) in the liquid crystal display 1 which is covered by the segment drive circuit 17-1. Other segment drive circuits 17-2 to 17-8 each is also equipped with RAM68 of same memory capacity.

Figure 12:
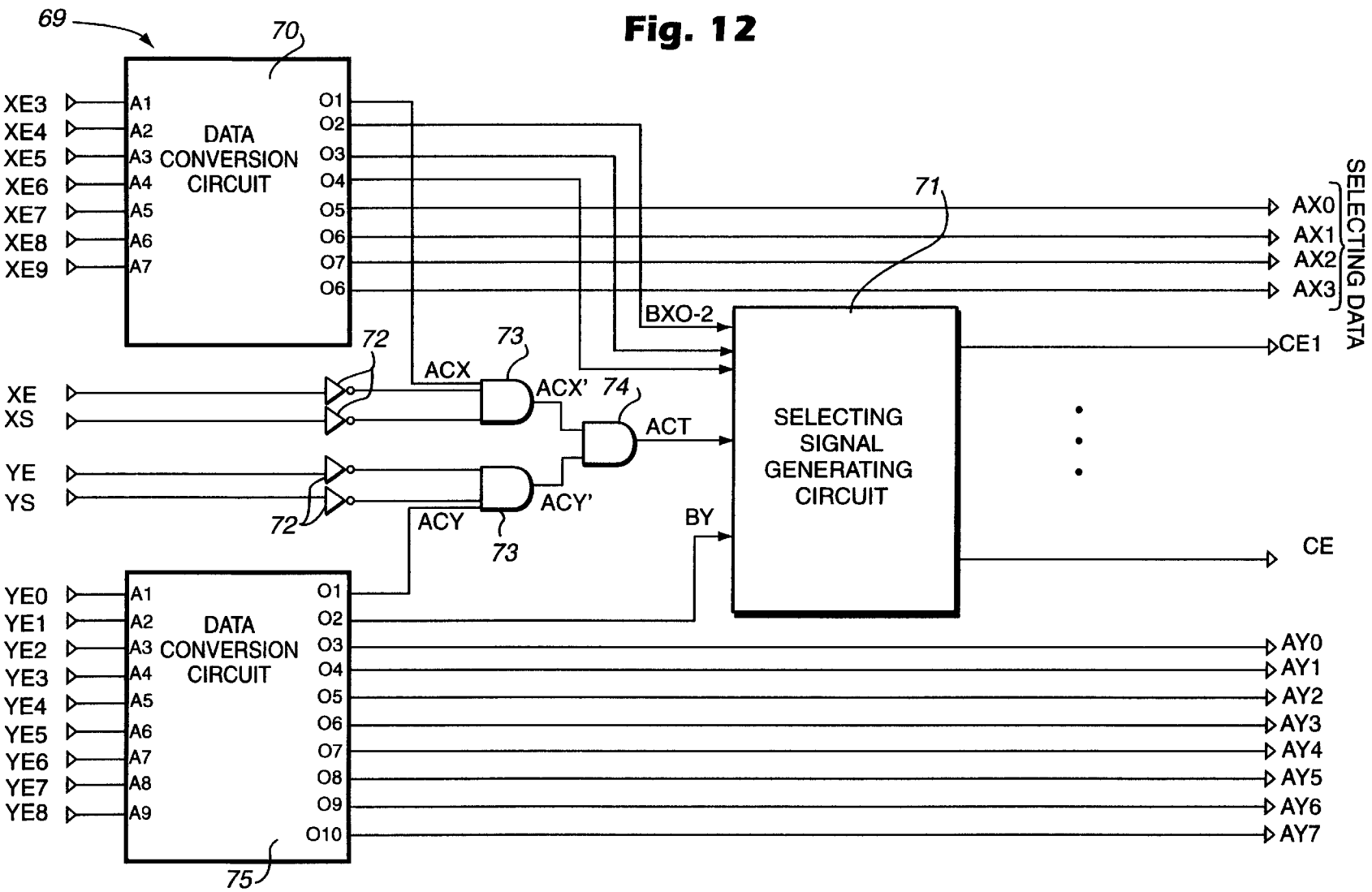
FIG. 12 is a block diagram showing an address arithmetic circuit 69 provided in a common drive circuit 1.

FIG. 12 is a block diagram showing the arrangement of an address operation circuit 69 provided in the memory control circuit 22 of the common drive circuit 1. The common drive circuit 1 receives address data of 11 bits including a sign bit with respect to X-direction addresses in the liquid crystal display unit 11, and also address data of 10 bits including a sign bit with respect to Y-direction addresses. On the basis of the address data input, the common drive circuit 1 outputs to individual data segment drive circuits 17 X-direction address data XE0 to XE9, extended bit XE, and sign bit XS, that is, address data of 12 bits in total, and Y-direction address data YE0 to YE8 extended bit Y, And sign bit YS, that is, address data of 11 bits in total.

It is noted that address data XE0 to XE9 and YE0 to YE8 are substantial address data portions, while extended bits XE, YE are outside the display space defined by the substantial address data XE0 to XE9 and YE0 to YE8 in the case where the address data input from CPU12 to the common drive circuit 1 are in excess of the display capacity of the display space 59, the extended bits being intended to regulate the address data within an extended address space set by combining same with the number of bits of the substantial address data. Sign bits XS, YS are plus and minus signs.

Some portions of the address data XE0 to XE9, say, XE3 to XE9 are input to a data conversion circuit 70 incorporating, for example, ROM. The data conversion circuit 70 outputs select data AX0 to AX3 for selecting one of row unit address ranges of 8 bits each Ai1, Ai2, . . . , Ai14 (Ai=1 to 8) provided in RAM68 for each Y-direction address In the display space 59 shown in FIG. 11.

When select data (AX0 to AX3)=0, 1, 2, for example, unit range A11, A21, A31 in RAM68 shown in FIG. 11 are selected correspondingly. Which bit in the selected unit range Aij is a starting bit with respect to the leading address of display data is determined from the X-direction address data XE0 to XE2 in manner as will be described later.

Select data BX0 to BX2 are input from the data conversion circuit 70 to a select signal generating circuit 71, which in turn outputs one of the select signals CE1 to CE8. The extended bit XE and sign bit XS are input to AND circuit 73 through an inversion circuit 72, together with an effective signal ACX output from the data conversion circuit 70, and output ACX' of the AND circuit 73 is input to AND circuit 74. Output of the AND circuit 74 is input to the select signal generating circuit 71.

The Y-direction address data YE0 to YE8 are input to a data conversion circuit 75 which, like the data conversion circuit 70, Incorporates ROM or the like. From the data conversion circuit 75 are input to AND circuit 73 effective signal ACY relating to Y-direction addresses, together with Inverted signals output through the inversion circuit 72 with respect to the extended bit YE and sign bit YS. Output ACY' of the AND circuit 73 is input to output circuit 74. The following arithmetic operations are carried out by the inversion circuit 72 and AND circuits 73, 74.

$$ACX' = ACX * \overline{XE} * \overline{XS} \tag{40}$$

$$ACY' = ACY * \overline{YE} * \overline{YS} \tag{41}$$

$$ACT = ACX' * ACY' \tag{42}$$

Where operation result of equation 42 is "1", the select signal generating circuit 71 detects that the address data Input from CPU12 to the common drive circuit 1 is within an address range corresponding to the display space 59, and only in that case select signals CE1 to CE8 can be output. The data conversion circuit 75 outputs a stage setting signal which indicates whether the display space 59 is of a single stage or of two or more stages in Y-direction. Where BY=0, the display space 59 is of one stage in Y-direction, as in the case of this embodiment. The data conversion circuit 75 outputs Y-direction address data AY0 to AY7 for supply to individual segment drive circuits 17.

In operation, when writing data In the virtual address (3070) within the display space 59 shown in FIG. 10, CPU12 transfers address data, together with display data, to the common drive circuit 1. At RAM68 of segment drive circuits 17, the display space is segmented into unit area Aij of 8 bits each as earlier mentioned, and writing/reading of display data is carried out for each of the unit areas. To write display data of horizontally successive 8 bits in an address of address data (30, 70), a unit area A9. 70 beginning with address (24, 70) in FIG. 11 is accessed, and subsequently a unit area A10, 70 beginning with address (32, 70) is accessed. Through such two-time accessing, an 8-bit data beginning with address (30, 70) is written.

Even when a write start address does not extend over two unit areas A as in (24, 70), two-time accessing with respect to two unit areas A9, 70; A10. 70 is carried out as mentioned above.

The manner of such accessing will be described in detail. In the case of writing display data beginning with write start address (30, 70) as exemplified above, the difference between the X-direction leading address 24 of unit area A9, 70 and the X-direction leading address 30 of display data is 30−24=6, and generally such subtraction result assumes a value of 0 to 7. Data SFTi are taken against such address difference shown in Table 3 below.

TABLE 3

| Address difference | SFTn |
|---|---|
| 0 | SFT0 |
| 1 | SFT1 |
| 2 | SFT2 |
| 3 | SFT3 |
| 4 | SFT4 |
| 5 | SFT5 |
| 6 | SFT6 |
| 7 | SFT7 |

Of the X-direction address data XE0 to XE9 accessed by the drive circuit 1, extended bit XE and sign bit XS, 3 bits of address data XE0 to XE2 not shown in FIG. 12 determine which one of the bits of units areas Aij be taken as X-direction write start address in the display data.

Therefore, the above tabulated data SFT0 to SFT7 are expressed by the following equations 43 to 50.

$$SFT0 = \overline{XE0} * \overline{XE1} * \overline{XE2} \tag{43}$$

$$SFT1 = XE0 * \overline{XE1} * \overline{XE2} \tag{44}$$

$$SFT2 = \overline{XE0} * XE1 * \overline{XE2} \tag{45}$$

$$SFT3 = XE0 * XE1 * \overline{XE2} \tag{46}$$

$$SFT4 = \overline{XE0} * \overline{XE1} * XE2 \tag{47}$$

$$SFT5 = XE0 * \overline{XE1} * XE2 \tag{48}$$

$$SFT6 = \overline{XE0} * XE1 * XE2 \tag{49}$$

$$SFT7 = XE0 * XE1 * XE2 \tag{50}$$

Where as FIG. 13 shows, component bits of individual unit areas Aij A (i+1) j are marked with symbols WBH7 to WBH0; WBL7 to WBL0, and where, in two successive unit areas A of which the first unit area consists of 8 bits WBH7 to WBH0 and of which the second unit area consists of 8 bits WBL7 to WBL0, display data 76 of 8 bits PM7 to PM0 shown in FIG. 14 assume the value of the foregoing data SFT0 to SFT7, areas corresponding to the display data 76 will cover respective 8-bit areas SFT0' to SFT7' shown in FIG. 13. Therefore, $$WBn = WBHn * \Delta 1 + WBLn * \Delta 2 \tag{51}$$

Symbols $\Delta 1$, $\Delta 2$denote that a data written immediately preceding thereto is used in accessing the first 8-bits WBH0 to WBH7, or In accessing the second 8 bits WBL0 to WBL7. Where subscript n=0 to 7, equation 51 is expressed by the following equations 52 to 59.

$$WB0 = \{SFT0 * PM0 + SFT1 * PM1 + SFT2 * PM2 + SFT3 * PM3 + SFT4 * PM4 + SFT5 * PM5 + SFT6 * PM6 + SFT7 * PM7\} * \Delta 1 \tag{52}$$

$$WB1 = \{SFT0 * PM1 + SFT1 * PM2 + SFT2 * PM3 + SFT3 * PM4 + SFT4 * PM5 + SFT5 * PM6 + SFT6 * PM0\} * \Delta 1 + \{SFT7 * PM0\} * \Delta 2 \tag{53}$$

$$WB2 = \{SFT0 * PM0 + SFT1 * PM3 + SFT2 * PM4 + SFT3 * PM5 + SFT4 * PM6 + SFT5 * PM7\} * \Delta 1 + \{SFT6 * PM0 + SFT7 * PM1\} * \Delta 2 \tag{54}$$

$$WB3 = \{SFT0 * PM3 + SFT1 * PM4 + SFT2 * PM5 + SFT3 * PM6 + SFT4 * PM7\} * \Delta 1 + \{SFT5 * PM0 + SFT6 * PM1 + SFT7 * PM2\} * \Delta 2 \tag{55}$$

$$WB4 = \{SFT0 * PM4 + SFT1 * PM5 + SFT2 * PM6 + SFT3 * PM7\} * \Delta 1 + \{SFT4 * PM0 + SFT5 * PM1 + SFT6 * PM2 + SFT7 * PM3\} * \Delta 2 \tag{56}$$

$$WB5 = \{SFT0 * PM5 + SFT1 * PM6 + SFT2 * PM7\} * \Delta 1 + \{SFT3 * PM0 + SFT4 * PM1 + SFT5 * PM2 + SFT6 * PM3 + SFT7 * PM4\} * \Delta 2 \tag{57}$$

$$WB6 = \{SFT0 * PM6 + SFT1 * PM7\} * \Delta 1 + \{SFT2 * PM0 + SFT3 * PM1 + SFT4 * PM2 + SFT5 * PM3 + SFT6 * PM4 + SFT7 * PM5\} * \Delta 2 \tag{58}$$

$$WB7 = \{SFT0 * PM7\} * \Delta 1 + \{SFT1 * PM0 + SFT2 * PM1 + SFT3 * PM2 + SFT4 * PM3 + SFT5 * PM4 + SFT6 * PM5 + SFT7 * PM6\} * \Delta 2 \tag{59}$$

For accessing address (30, 70) as write start address, area SFT6' shown in FIG. 13 is selected, and for accessing address data (24, 70) as write start address, area SFT0' shown in FIG. 13 is selected. Therefore, values of data WB0 to WB7 are as follows:

In the case of address (30, 70) (SFT6):

$$WB0 = PM6 * \Delta 1 \tag{60}$$

$$WB1 = PM7 * \Delta 1 \tag{61}$$

$$WB2 = PM0 * \Delta 1 \tag{62}$$

$$WB3 = PM1 * \Delta 1 \tag{63}$$

$$WB4 = PM2 * \Delta 2 \tag{64}$$

$$WB5 = PM3 * \Delta 2 \tag{65}$$

$$WB6 = PM4 * \Delta 2 \tag{66}$$

$$WB7 = PM5 * \Delta 2 \tag{67}$$

In the case of address (24, 70) (SET0):

$$WB0 = PM0 * \Delta 1 \quad (68)$$

$$WB1 = PM1 * \Delta 1 \quad (69)$$

$$WB2 = PM2 * \Delta 1 \quad (70)$$

$$WB3 = PM3 * \Delta 1 \quad (71)$$

$$WB4 = PM4 * \Delta 1 \quad (72)$$

$$WB5 = PM5 * \Delta 1 \quad (73)$$

$$WB6 = PM6 * \Delta 1 \quad (74)$$

$$WB7 = PM7 * \Delta 1 \quad (75)$$

A circuit for carrying out arithmetic operation of the foregoing equations 40 to 75 is provided in the common drive circuit 1, whereby it is possible to make write/read access without processing data at CPU12 considering delimitation of data at 8-bit intervals.

The above explanation concerns the case of writing display data in the display space 59 in X direction. Next, the manner of writing display data in Y direction will be explained. When 8-bit data are to be written in Y-direction beginning from write start address (40, 40) as in display area E2 shown in FIG. 10, writing is made by accessing eight unit areas A4, 40; A4, 41, . . . , A4, 47 of write start addresses (40, 41), . . . , (40, 47) In succession as shown In FIG. 15, that is, accessing eight times in all.

In the case of unit area A4, 40, data SFT0 is selected from Table 3. Where the write start address for 8 bits successive in Y-direction is address (45, 40), for example, data SFT5 is selected from Table 3. For accessing in the column or column-writing direction, as can be seen from the memory map for RAM68 in FIG. 16, access is made eight times in succession with respect to eight sets of X-direction 8-bit data C1, C2, . . . , C8, and only bits selected by data SFTi (i=0 to 7) are effective and are written accordingly.

More specifically, when 8-bit data are to be written in Y-direction beginning from write start address (40, 40) as shown in FIG. 10, individual bit data PM 7 to PM 0 of display data 76 are written in such a manner that at a first writing operation, data of most significant bit PM7 only is written as shown in FIG. 17 (2), and remaining bit data PM6 to PM0 are shifted one bit each to the left.

Then at the time of second writing, bit data PM6 only is written as FIG. 17 (3) shows. Subsequently, similar operation is repeated until display data of 8 bits successive in Y direction are written.

Such series of operation is generally expressed by the following equations 76 to 83.

$$WB0 = SFT7 * (PM7 * C1 + PM6 * C2 + PM5 * C3 + PM4 * C4 + PM3 * C5 + PM2 * C6 + PM1 * C7 + PM0 * C8) \quad (76)$$

$$WB1 = SFT6 * (PM7 * C1 + PM6 * C2 + PM5 * C3 + PM4 * C4 + PM3 * C5 + PM2 * C6 + PM1 * C7 + PM0 * C8) \quad (77)$$

$$WB2 = SFT5 * (PM7 * C1 + PM6 * C2 + PM5 * C3 + PM4 * C4 + PM3 * C5 + PM2 * C6 + PM1 * C7 + PM0 * C8) \quad (78)$$

$$WB3 = SFT4 * (PM7 * C1 + PM6 * C2 + PM5 * C3 + PM4 * C4 + PM3 * C5 + PM2 * C6 + PM1 * C7 + PM0 * C8) \quad (79)$$

-continued $$WB4 = SFT3 * (PM7 * C1 + PM6 * C2 + PM5 * C3 + PM4 * C4 + PM3 * C5 + PM2 * C6 + PM1 * C7 + PM0 * C8) \quad (80)$$

$$WB5 = SFT2 * (PM7 * C1 + PM6 * C2 + PM5 * C3 + PM4 * C4 + PM3 * C5 + PM2 * C6 + PM1 * C7 + PM0 * C8) \quad (81)$$

$$WB6 = SFT1 * (PM7 * C1 + PM6 * C2 + PM5 * C3 + PM4 * C4 + PM3 * C5 + PM2 * C6 + PM1 * C7 + PM0 * C8) \quad (82)$$

$$WB7 = SFT0 * (PM7 * C1 + PM6 * C2 + PM5 * C3 + PM4 * C4 + PM3 * C5 + PM2 * C6 + PM1 * C7 + PM0 * C8) \quad (83)$$

In practice, for access in Y direction beginning from write start address (40, 40), data SFT0 is selected, and for 8-bit accessing in the column-writing direction beginning from write start address(45, 40), data SFT5 is selected. Therefore, the value of data WB0 to WB7 for each successive 8-time writing operation (shown by symbols C1 to C8 used in FIG. 16) will, for example, be as follows:

In case of write start address (40, 40) SFT0 and accordingly:

$$WB7=SFT0*(PM7*C1+PM6*C2+PM5*C3+PM4*C4+PM3*C5+PM2*C6+PM1*C7+PM0*C8) \quad (84)$$

In case of write start address (45, 40), SFTS and accordingly:

$$WB2=SFT5*(PM7*C1+PM6*C2+PM5*C3+PM4*C4+PM3*C5+PM2*C6+PM1*C7+PM0*C8) \quad (85)$$

Therefore. where data of 8 successive bits in the Y direction are to be written in the display space 59, by providing a circuitry for carrying out arithmetic operations according to the foregoing equations 76 to 83, it is possible to cause satisfactory display operation to be performed, without CPU12 being required to carry out data processing to cover data delimitation for each 8 bits at RAM68 of segment drive circuits 17.

In this embodiment, as described above, series of arithmetic operations necessary for X-direction or Y-direction display in the display space 59 are carried out by hardware at the common drive circuit 1. Therefore, it is possible to reduce the burden of CPU12 or software required In connection with display operation and also to achieve high-speed display performance. Furthermore, as earlier stated, the embodiment provides for easy display operation In X- and Y-directions In the display space 59.

Next, a data processing unit 2*b* representing a second embodiment of the invention will be described. The data processing unit 2*b* is of same configuration as that shown with respect to the first embodiment in FIGS. 4 to 6. detailed description of its arrangement being therefore omitted.

FIG, 18 is a block diagram showing, by way of example, detailed arrangement of the common drive circuit 1. A control 30, a loop counter 31, a command register 32, a status register 33, and a data control 34 constitutes the control circuit 19 of FIG. 4. The control 30 controls the entire common drive circuit 1, and the loop counter 31 controls the count of successive execution of command data set from CPU12 into the command register 32. The status register 33 stores therein the operation status of the common drive circuit 1 at the present point of time so that CPU12 can detect the operation status of the common drive circuit 1 by reading the contents of storage at the status register 33. The data control 34 controls data sent to and received from CPU12 through the buffer 20.

An arithmetic circuit 35, a data register 36, an arithmetic mode register 37, and a mask register 38 constitutes the data processing circuit 21 shown in FIG. 4. The arithmetic circuit 35 carries out various logical operations (such as SET, OR, AND, and XOR) prescribed by the arithmetic mode register 37 with data from CPU12 stored in the data register 36 in relation to segment data to be described later and, when the common drive circuit 1 is in the status of writing for transfer of data to segment drive circuits 17, the arithmetic circuit 35 transfers data obtained to the segment drive circuits 17, and when the common drive circuit 1 is in the status of writing for transfer of data to CPU12, the circuit 36 transfers data obtained to CPU12 through the data control 34.

In this case, arithmetic operation may be masked by data in a mask register 38. That is, a condition for non-operation may be set. Executable mask data which are obtained in the window processing circuit 29 as will be described later are masked on the basis of data in the mask register 38.

The memory control circuit 22 includes write address registers 41X, 41Y and read address registers 42X, 42Y. When write addresses XW, YW or read addresses XR, YR stored In these registers are entered as absolute addresses from CPU12, a memory control 40 outputs select signals CE1 to CE8 for selecting one of the segment drive circuits 17 shown In FIG. 5, which are eight in number, for example, and also outputs to the segment drive circuits 17 a control signal LR/W for setting either writing status or reading status. Adder-subtracter circuits 43, 44, after execution of an address data write command or the like command from the address registers 41X, 41Y; 42X, 42Y, automatically carries out arithmetic operation for automatically incrementing or decrementing by ±8 or ±1 in accordance with a designation from a adder-subtracter circuit 45.

The window processing circuit 29 has a window pointer memory 47 which stores sets of two pairs each of address data defining a plurality of rectangular window areas preset in the liquid crystal display unit 11, for the number of window areas. Data stored in the window pointer memory 47 are compared, at a subtracter circuit 48, with data obtained by conversion at a data conversion circuit 49 with respect absolute addresses (XW, YW); (XR, YR) stored in the address registers 41X, 41Y; 42X, 42Y, and a mask pattern which will be described later is prepared, which is stored in a mask pattern memory 50.

As already stated, window areas set in the liquid crystal display unit 11 are generally plurality set. A number data showing a corresponding area In the set of window areas with respect to a particular display area in which present data is to be written or read is stored in a window pointer 51. As will be explained later, window processing is carried out for each window area by counting window numbers at the window pointer 51 beginning from 0 th area until the number coincides with the number data at the window pointer 51. Upon coincidence in number, a coincidence circuit 53 outputs a mask pattern end signal.

The process of registration with respect to a window mask pattern is carried out at a first registration area 54, and the mask pattern obtained is stored in a window mask area 56. The registered window mask pattern obtained at the first registration area 54 is processed at a second registration area 57 for registration with a bit mask register 56 which can specify data for each bit, in accordance with a procedure set by CPU12. A finally obtained executable mask is stored in an execute mask area 58. The arithmetic circuit 35 carries out various logical operations with the executable mask in relation to segment data from a buffer 39.

Figure 19:
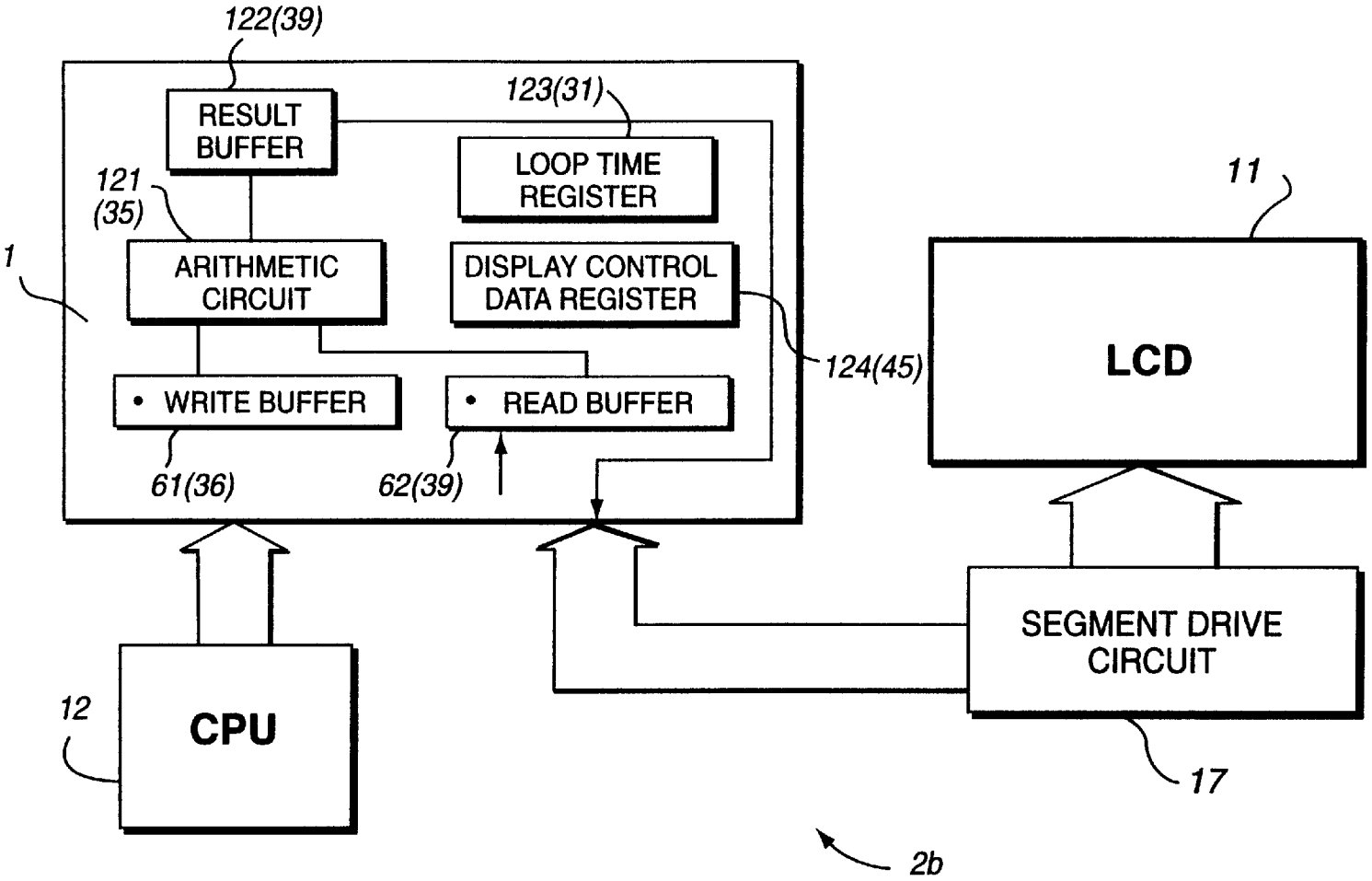
FIG. 19 is a block diagram schematically showing a related arrangement of the liquid crystal display unit 11.

FIG. 19 is a block diagram schematically showing the arrangement of the data processing unit 2*b*. As already stated, the common drive circuit 1 and segment drive circuits 17 are connected to the liquid crystal display unit 11, and they respectively output common address data and segment address data. The segment drive circuits 17 also output display data. In this case, CPU12 has inter-transfer connection with the common drive circuit 1 with respect to display data and address data, while the segment drive circuits 17 have inter-transfer connection with the common drive circuit 1 with respect to display data and drive address data and have no direct data send/receive connection with CPU12.

The common drive circuit 1 includes a write buffer 61 for storing write data from CPU12, a read buffer 62 for storing read data that are read from the segment drive circuits 17, an arithmetic circuit 121 which carries out such arithmetic operation with respect to data stored in the buffers 61, 62 as will be described hereinafter, and a result buffer 122 for storing operation results at the arithmetic circuit 121. Further, the common drive circuit 1 includes a loop count register 123 for storing loop count data sent from CPU12 with respect to repeat count of arithmetic operation at the arithmetic circuit 121, and a display control data register 124 for storing display control data, such as write address written at time of writing following a first writing.

The write buffer 61 corresponds to the data register 36, and the read buffer 62 corresponds to the buffer 39. The arithmetic circuit 121 corresponds to the arithmetic circuit 35 shown in FIG. 18, and the buffer 122 corresponds to the buffer 39. The loop count register 123 corresponds to the loop counter 31, and the display control data register 124 corresponds to the adder-subtracter register 45.

Figure 20:
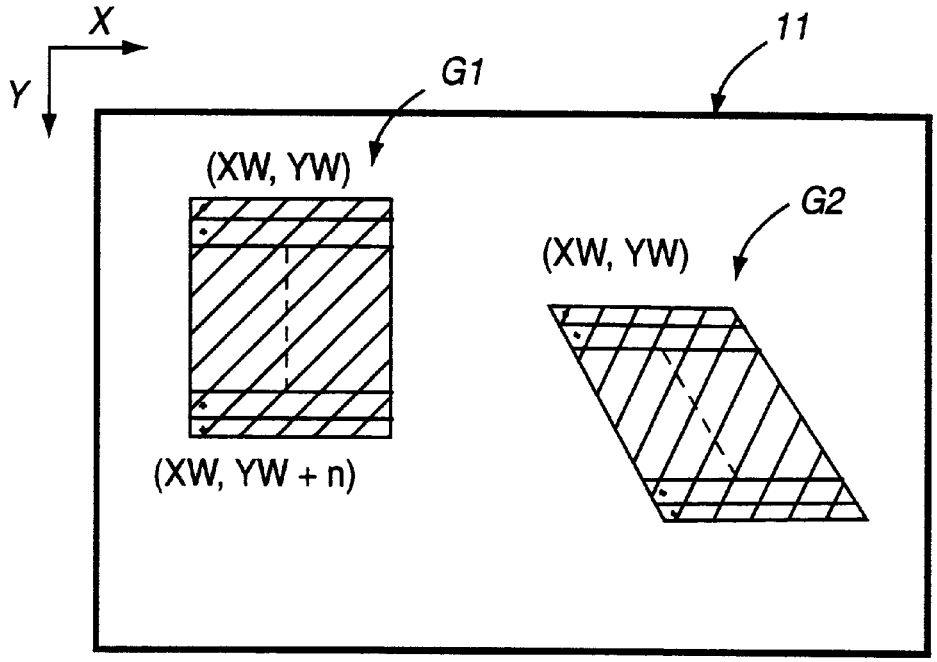
FIGS. 20 and 21 view showing display aspects of the embodiment by way of example.

FIG. 20 is a view showing an example of display at the liquid crystal display unit 11. In this embodiment, display at the liquid crystal display unit 11 is made in units of 8 bits in which display start address(XW, YW) in case of write command is most significant bit. Prior to execution of a continuous write loop command, CPU12 specifies kinds of operation (such as SET, OR, AND, and XOR) to be made by the operation mode register 37 of the common drive circuit 1, and write start addresses (XW, YW) shown in FIG. 20 are respectively stored in the write address registers 41X, 41Y.

In the case of a continuous write loop command, a write command is repetitively executed in plural counts. In this case, loop count data are stored in the loop count register 123, or loop counter 31, and addressing as to write start address for writing subsequent to the first writing is stored in the display control data register 124, or adder-subtracter register 45. Any one control data, for example, 0, +1, or +8, may be set in the adder-subtracter register 46 and, accordingly, "no change", "+1" or "8" is set in X direction and Y direction with respect to write start address for each write command.

After such prior processing, write data or display data is transferred from CPU12 to the write buffer 61 or data register 36, whereupon the common drive circuit 1 carries out required arithmetic operation at its arithmetic circuit 121 with respect to the write data from the write buffer 61 and, thereafter, transfers to the relevant segment drive circuit 17 the result of operation stored in the result buffer 122.

Figure 18:
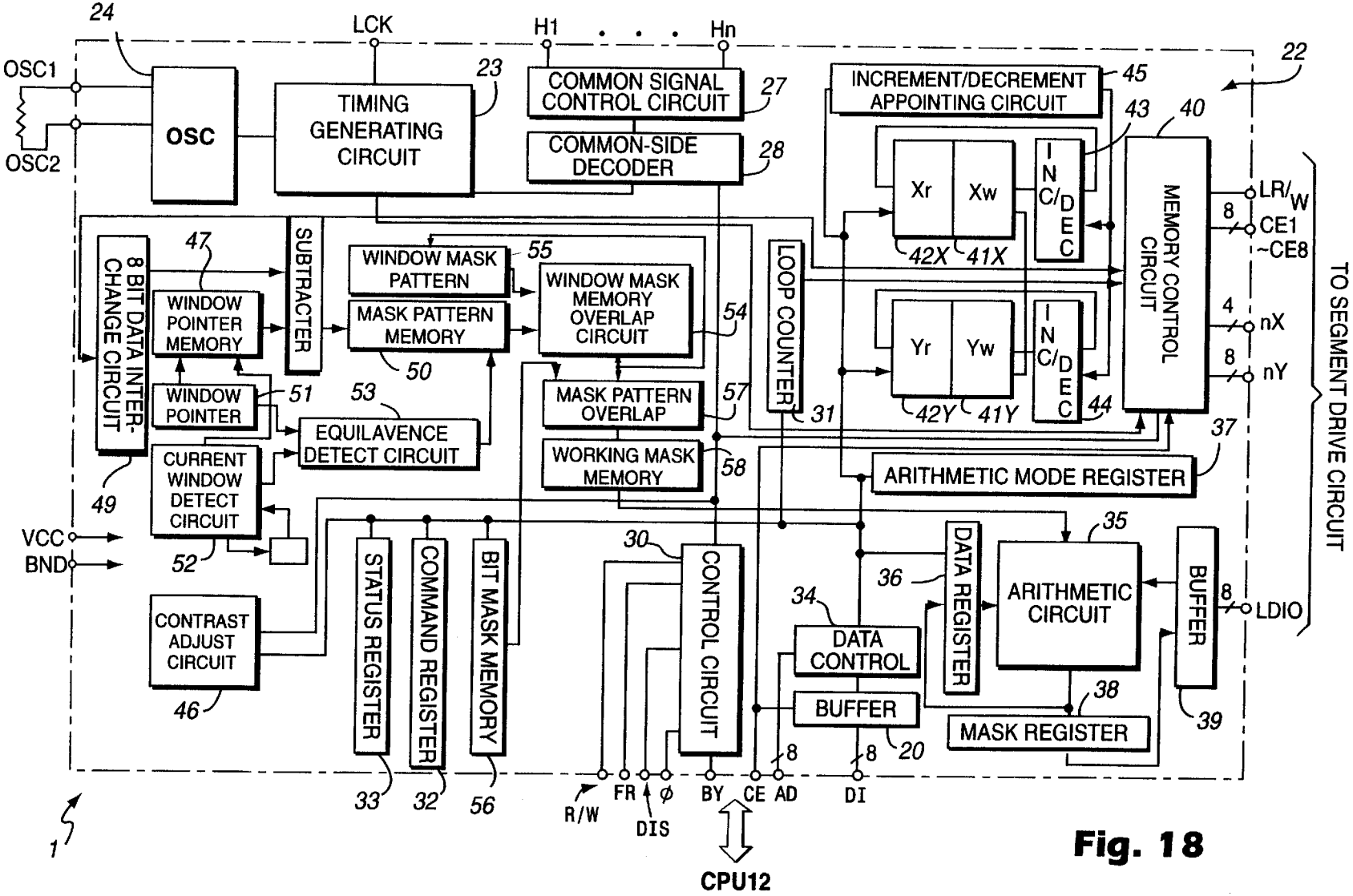
FIG. 18 is a block diagram showing by way of example the arrangement of the common drive circuit 1.

Referring to the picture GI shown in FIG, 20, each time write data is written, Y-direction address is incremented +1 each, with no change in X-direction address. In FIG. 18, display data is set at "0" in the adder-subtracter circuit 43, while display control data is set at "1" in the adder-subtracter register 45. When loop count data is set at n in the loop count register 31, the count value at the loop count register 31 is decremented by −1 each time write command is executed, and the write command ends when the count value reaches 0. Accordingly, at picture G1, 8-bit display data are written over a write start address range of (XW, YW) to (XW, YW+n).

In the case of picture G2 shown in FIG. 20, display is made in same way as in the case of picture G1 except that the display control data register 124, or adder-subtracter register 45, is set so that display control data "1", for example, is set in both of the adder-subtracter circuits 43, 44.

Figure 21:
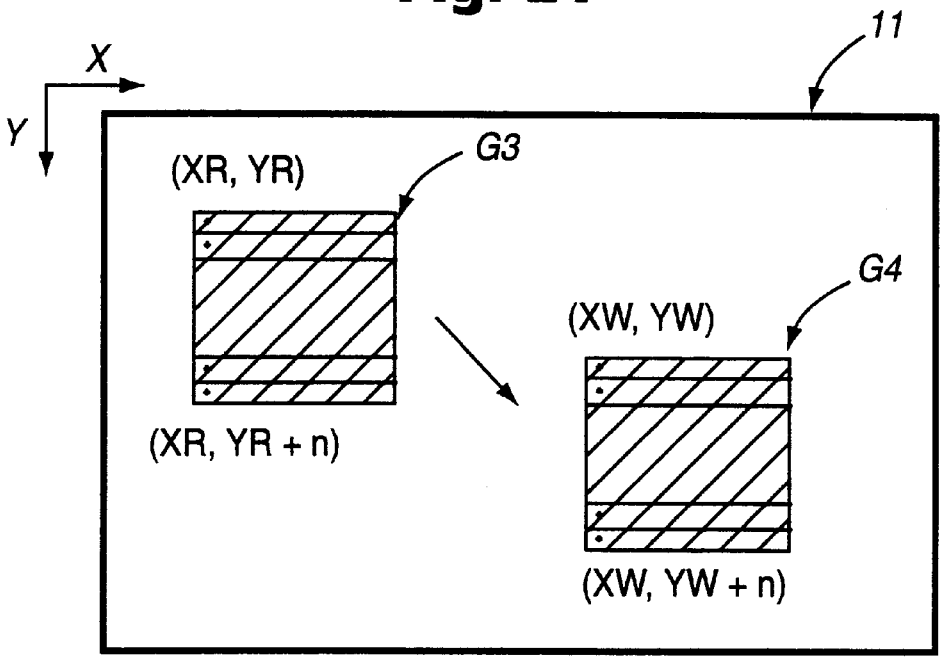

FIG. 21 is a diagram showing another example of display. In this example, picture G3 in which display start address (XR, YR) are displayed in the liquid display unit 11 are shifted as picture G4 in a display area beginning from display start address (XW, YW). Such a processing command with respect to a picture already in display in the liquid crystal display unit 11 is a block transfer loop command.

Prior to the execution of the command, read start address (XR, YR) for a picture to be read in the liquid crystal display unit 11 and write address for writing post-operation read data are stored In the write address register 41X, 41Y and read address register 42X, 42Y shown in FIG. 18. Address designation as to read address after one-time transfer is set in the display control data register 124 or adder-subtracter register 45.

After such prior processing, CPU12 transfer a block transfer loop command to the common drive circuit 1, which in turn reads 8-bit data for prescribed read address (XR, YR) from segment drive circuits 17 into the read buffer 62 and carries out arithmetic operation at the arithmetic circuit 121 with respect to the data, and then write the operation result, which is stored in the result buffer 122, in write start address (XW, YW) designated by the write address registers 41X, 41Y.

Where loop count data n has been set in the loop counter register 123, read data for an address ranges of read start address ranges (XR, YR) to (XR, YR+n) are written in an address range of write data ranges (XW, YW) to (XW, YW+n) in the liquid crystal display unit 11. In this display example, it is assumed that in the adder-subtracter circuit 43, 44, data 0 is set in X direction and data +1 in Y direction for both the write address registers 41X, 41Y and read address registers 42X, 42Y. Such loop processing stops when count value at the loop count register 123 reaches 0.

As described above, in this embodiment, it is arranged that successive write loop command and block transfer loop command for various display operations in the liquid crystal display unit 11 are generated by hardware means provided in the common drive circuit 1. By this arrangement it is possible to reduce the burden of the hardware regulating the operation of the data processing unit 2*b* and to provide for high speed display operation.

Next, a data processing unit 2*c* representing a fourth embodiment of the invention will be described. The data processing unit 2*c* of this embodiment is of same configuration as the arrangement of the first embodiment shown in FIGS. 4 to 6. Therefore, detailed description of the identical parts is omitted.

Figure 22:
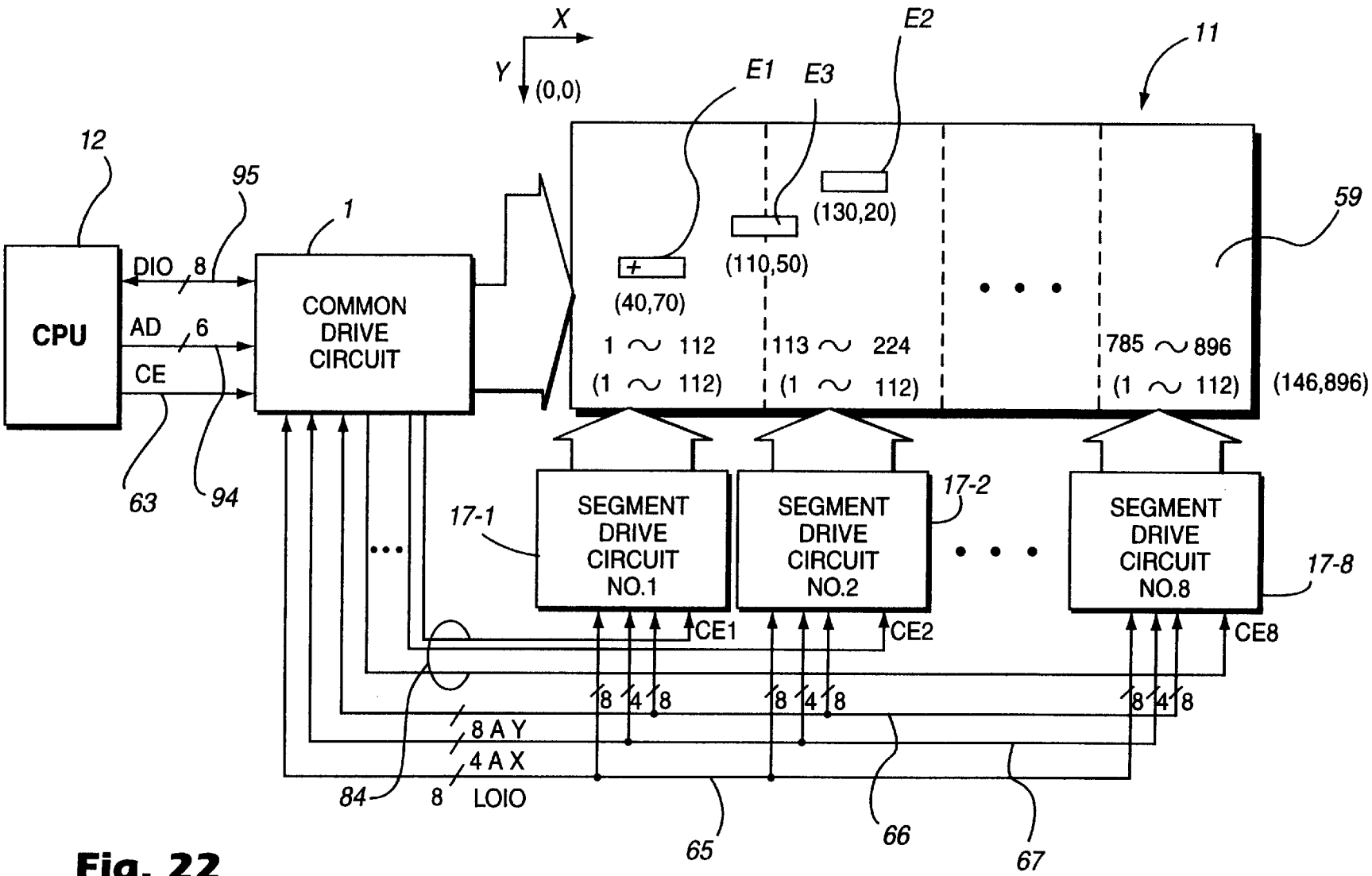
FIG. 22 is a block diagram Illustrating a wiring configuration in an arrangement related to the liquid crystal display unit 11.

FIG. 22 is a circuit diagram illustrative of the wiring arrangement related to the liquid crystal display unit 11. Between CPU12 and the common drive circuit 1 there are provided an 8-bit data bus 95, a 6-bit address bus 94, and a control line 63 through which a select signal CE for selecting the common drive circuit 1 is output. Between the common drive circuit 1 and individual segment drive circuits 17-1 to 17-8 there are provided eight control lines 84 separately connected to the individual segment drive circuits 17-1 to 17-8 and through which select signals for selecting one of the segment drive circuits 17-1 to 17-8 are output, an 8-bit data bus 65, an address bus 66 for supply of 8-bit address data AY on Y-direction addresses in the liquid crystal display unit 11, and an address bus 67 for supply of 4-bit address data AX on X-direction addresses.

The liquid crystal display unit 11 in this embodiment, has a virtual address space set therein having an virtual address range of from address (0, 0) at upper left corner and to address (146, 895) at lower right corner. The segment drive circuits 17-1 to 17-8 are disposed at predetermined address intervals (for example, 112 bits) along the line writing line in the liquid crystal display unit 11. In other words, the segment drive circuit 17-1 serves a row address range of 0 to 111, and the segment drive circuit 17-2 serves a row address range of 112 to 223. Likewise, the segment drive circuit 17-8 serves a row address range of 784 to 895.

In this embodiment, to write display data in the liquid crystal display unit 11, data are written in row series of successive 8-bit units as shown in area E1 of FIG. 22. Therefore, address data AD from CPU12 are output as virtual address data AD in the virtual space. The common drive circuit 1 of the embodiment, output, on the virtual address data AD, select signals CE1 to CE8, and real address AX in selected segment drive circuit 17-i (i=1 to 8). In this embodiment, the segment drive circuits 17-1 to 17-8, each has a real address range of 1 to 112 in X direction.

Figure 23:
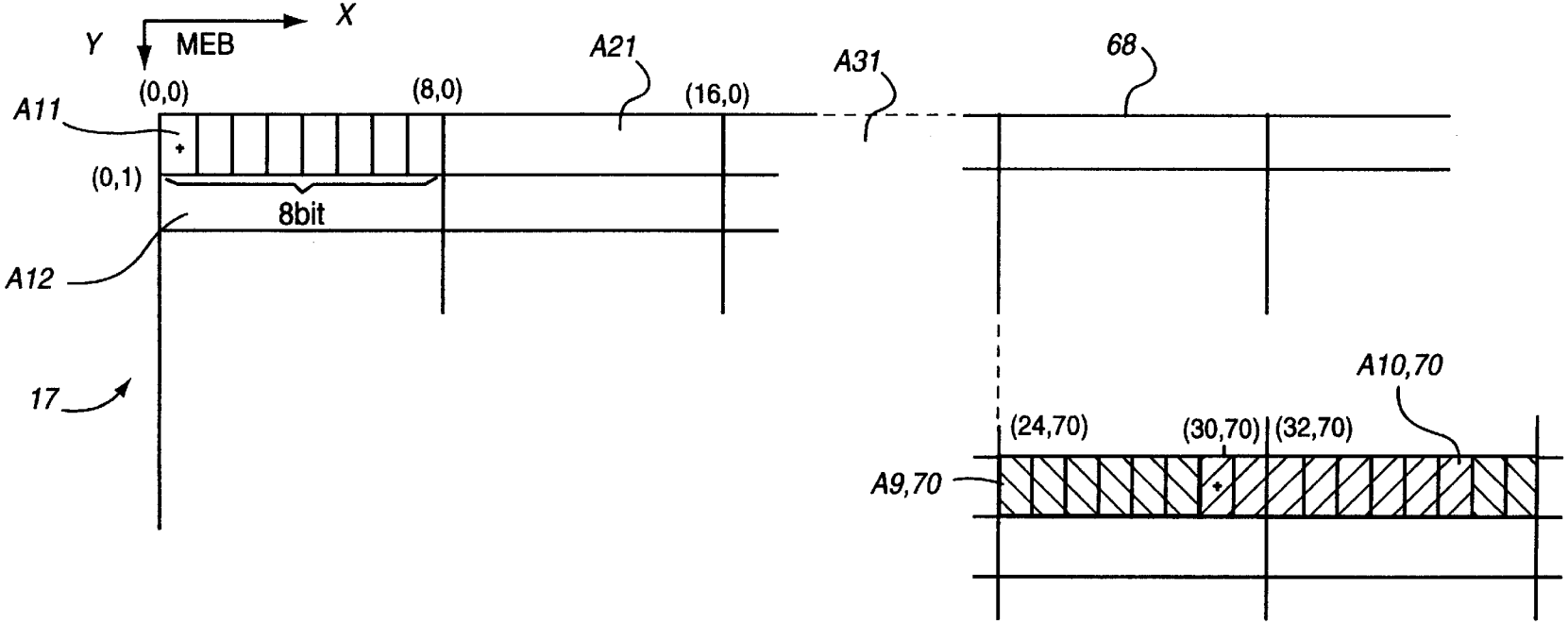
FIG. 23 is a memory map of RAM68 in a segment drive circuit 17.

FIG. 23 is a diagram showing the arrangement of segment drive circuits 17. Each of the segment drive circuit 17-1 to 17-8 comprises RAM68, in which display data transferred through the data bus 65 from write start addresses designated by address data AX, AY from the address buses 66, 67 are in units of 8 bits in line writing direction. The addressing range of RAM68 corresponds, for example, to the address range (0, 0) to (146, 111) in the liquid crystal display unit 11 which is served by the segment drive circuit 17-1. The other segment drive circuits 17-2 to 17-8 each has RAM68 of same memory capacity.

Figure 24:
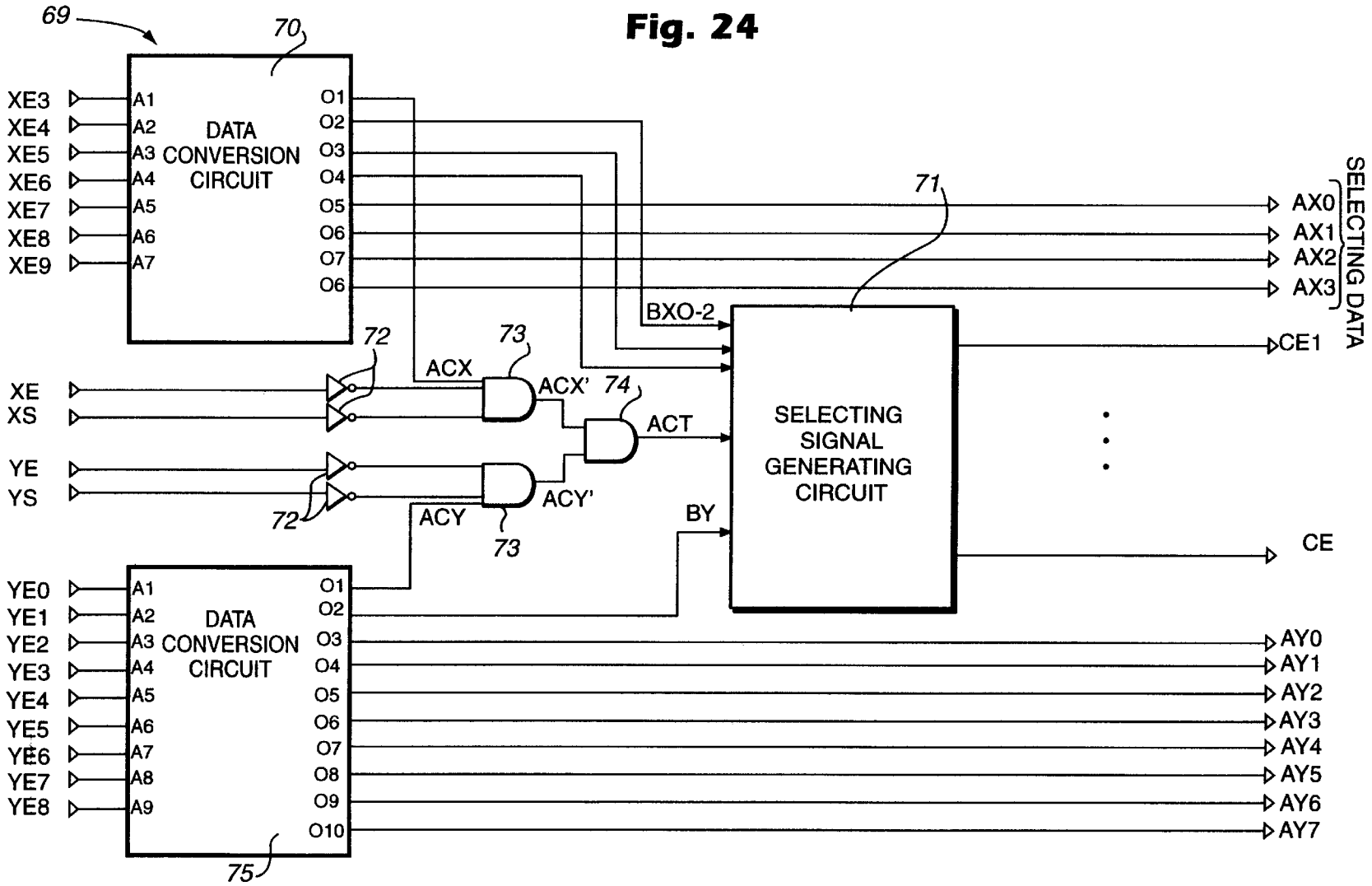
FIG. 24 is a block diagram showing an address arithmetic circuit 69 provided in common drive circuit 11.

FIG. 24 is block diagram showing the arrangement of an address operation circuit 69 provided in the memory control circuit 22 of the common drive circuit 1. The common drive circuit 1 receives from CPU12 an 11-bit address data including a sign bit on X-direction of the liquid crystal display unit 11, and a 10-bit address data including a sign bit on Y-direction. The common drive circuit 1 generates, for supply to the segment drive circuits 17, a 12-bit address data including address data XE0 to XE9, extended bit XE, and sign bit XS in X directions and a 11-bit address data including address data YE0 to YE8, extended bit YE, and sign bit YS.

It is noted that address data XE0 to XE9; YE0 to YE8 are a substantial part of the address data, and extended bits XE, YE are outside a display area 59 defined by the substantial address data XE0 to XE9; YE0 to YE8, when the address data input to the common drive circuit 1 from CPU12 exceed the display capacity of the display area 59. It is intended that by combining the extended bits XE and YE with the substantial address data, an extended address area is set for regulating the address data there within. Sign bits XS, YS denote plus or minuis relation of the address data.

Address data XE3 to XE9 portion of the X-direction address data XE0 to XE9 is input to a data conversion circuit 70 comprising, for example, ROM or the like. The data conversion circuit 70 is such that output data 01 to 08 have previously written therein at addresses corresponding to input data A1 to A7 shown in Table 4 below. The circuit 70 outputs select data AX0 to AX3 for selecting one of X-direction unit areas Ai1, Ai2, . . . , Ai14 (i+1 to 146) for each 8 bit extending in X direction provided for each Y-direction address In the display area of RAM shown in FIG. 23.

TABLE 4

| A7~A1 | 08~01 | | | |
|---|---|---|---|---|
| XE9~XE3 | AX3~AX0 | BX2~BX0 | ACX | CEi |
| 0000000 | 0000 | 000 | 1 | CE1 |
| 0000001 | 0001 | 000 | 1 | |
| 0000010 | 0010 | 000 | 1 | |
| 0000011 | 0011 | 000 | 1 | |
| 0000100 | 0100 | 000 | 1 | |
| 0000101 | 0101 | 000 | 1 | |
| 0000110 | 0110 | 000 | 1 | |
| 0000111 | 0111 | 000 | 1 | |
| 0001000 | 1000 | 000 | 1 | |
| 0001001 | 1001 | 000 | 1 | |
| 0001010 | 1010 | 000 | 1 | |
| 0001011 | 1011 | 000 | 1 | |
| 0001100 | 1100 | 000 | 1 | |
| 0001101 | 1101 | 000 | 1 | |
| 0001110 | 0000 | 001 | 1 | CE2 |
| . | . | . | . | |
| . | . | . | . | |
| . | . | . | . | |
| 0011011 | 1101 | 001 | 1 | |
| 0011100 | 0000 | 010 | 1 | CE3 |
| . | . | . | . | |
| . | . | . | . | |
| . | . | . | . | |
| 0101001 | 1101 | 010 | 1 | |
| 0101010 | 0000 | 011 | 1 | CE4 |
| . | . | . | . | |
| . | . | . | . | |
| . | . | . | . | |

In the address operation circuit 69 shown in FIG. 24, virtual address data AD are converted, on the basis of the following equation, into selection signal CEi and real address AX, $$AD+112*(i-1)+AX \tag{86}$$

where i denotes a subscript.

In this case, where select data (AX0 to AX3) +0, 1, 2, unit areas A11, A21, A31, for example, in RAM68 shown in FIG. 23 are selected accordingly. A particular bit of the selected unit area Aij from the leading address of the display data starts is determined on the basis of the X-direction address data XE0 to XE2.

The data conversion circuit 70 outputs by data conversion as shown in Table 4 select data BX0 to BX3 to the select signal generating circuit 71, and select signals BX0 to BX3 of 3 bits are decoded and one of the select signals CE1 to CE8 is output. The extended bit XE and sign bit XS are passed through an inverter circuit 72 and input to AND circuit 73 together with effective signal ACX output from the data conversion circuit 70 on the basis of the Table 4, and the output ACX' Is input to the AND circuit 74. The output of the AND circuit 74 is input to the select signal generating circuit 71.

Y-direction address data YE0 to YE8 are input to a data conversion circuit 75 comprising ROM or the like which is of same arrangement as the data conversion circuit 70 and which is operative to convert Y-direction address data. Extended bit YE and sign bit YS are Input to AND circuit 73 together with signals inverted through the invert circuit 72. The output of ACX' is input to the AND circuit 74.

TABLE 5

| A9~A1 | 010~01 | | |
|---|---|---|---|
| YE8~YE0 | AY7~AY0 | BY | ACY |
| 000000000 | 00000000 | 0 | 1 |
| 000000001 | 00000001 | 0 | 1 |
| 000000010 | 00000010 | 0 | 1 |
| 000000011 | 00000011 | 0 | 1 |
| 000000100 | 00000100 | 0 | 1 |
| 000000101 | 00000101 | 0 | 1 |
| 000000110 | 00000110 | 0 | 1 |
| 000000111 | 00000111 | 0 | 1 |
| 000001000 | 00001000 | 0 | 1 |
| 000001001 | 00001001 | 0 | 1 |
| 000001010 | 00001010 | 0 | 1 |
| 000001011 | 00001011 | 0 | 1 |
| 000001100 | 00001100 | 0 | 1 |
| . | . | . | . |
| . | . | . | . |
| . | . | . | . |

In this case, the following arithmetic operations are carried out by the invert circuit 72 and AND circuits 73, 74.

$$ACX' = ACX * \overline{XE} * \overline{XS} \tag{87}$$

$$ACY' = ACY * \overline{YE} * \overline{YS} \tag{88}$$

$$ACT = ACX' * ACY' \tag{89}$$

If the result of the operation according to equation 89 is "1", the fact that the address data input from CPU12 to the common drive circuit 1 is within an address range corresponding to the display area 59 is detected by the select signal generating circuit 71, in which case only select signals CE1 to CE8 can be output. The data conversion circuit 75 outputs a stage setting signal BY as a result of Table 5 data conversion. This signal signifies that the display area 59 is of one or more stage configuration. Where BY=0. the display area if of one stage configuration, which corresponds to the case of the embodiment. The data conversion circuit 75 outputs Y-direction address data AY0 to AY7 for supply to individual segment drive circuits 17 as a result of Table 5 data conversion.

The manner of operation of the address operation circuit 69 will be explained in detail. To write address area E1 in which most significant bit address is (40, 70) in the liquid crystal display unit 11, CPU12 outputs virtual address (40, 70) to the common drive circuit 1. Y-direction component of the virtual address AD is 70, from which i=0, AX=70 are obtained as a result data conversion according to equation 86 or Table 4. Then select signal CE1 is output to select segment drive circuit 17-1, which in turn writes display area E1 from the real address (40, 70).

To write a display area (130, 20) in which virtual address of most significant bit is (130, 20), CPU12 outputs the virtual address (130, 20) to the common drive circuit 1. The Y-direction component of the virtual address is 130, from which is obtained i=2, AX=18 similarly from the first equation. Then, select signal CE2 is output and the selected segment drive circuit 17-2 writes display area E2 from the real address (18, 20).

Where the virtual address of most significant bit is (110, 50) as in display area E3 shown in FIG. 22, the 8-bit display area E3 extends over respective control ranges of the segment drive circuits 17-1, 17-2. In such case, the common drive circuit 1 selects the segment drive circuit 17-1 for the virtual address range of (110, 50) to (112, 60) of area E3, and selects the segment drive circuit 17-2 for the virtual address range of (113, 50) to (117, 50).

Such address data conversion is carried out whether It is for data writing or for data reading. CPU12 may neglect addressing range divisions in the liquid crystal display unit 11 between individual segment drive circuits 17-1 to 17-8 in outputting virtual address data based on the entire address range of (0, 0) to (146, 896). Such address conversion can be accomplished by hardware of such configuration as shown in FIG. 24. Thus, high-speed display operation of the liquid crystal display can be realized.

The invention has been described with respect to the liquid crystal display unit 11, but it is equally applicable to other applications in which addresses are set in the display space for display purposes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A display control circuit comprising:

a plurality of row drive means connected to a display means having a display space in which addresses are set in a matrix fashion, each said row drive means being provided for only a predetermined addressing range of a total range of addresses within the display space and each being operative to output relative row address data within the predetermined addressing range and display data respectively associated therewith, and column drive means connected to both the row drive means and the display means for outputting column address data to the display means, said column drive means also being operative to output a select signal for selecting one of the plurality of row drive means, and for outputting relative row and column address data and display data for each selected row drive means, and control means for outputting display data and address data to the column drive means, the column drive means including a select signal generating means for outputting the select signal on the basis of address data input from the control means, and address data conversion means for outputting relative row and column address data for each row drive means on the basis of the address data.

2. A display control circuit comprising:

a plurality of address output means connected to a display means having a display space in which addresses are set in the form of a matrix, the plurality of address output means extending along one direction of the matrix, each of said plurality being operative to output relative address data for only a predetermined address range portion of a total range of addresses in said display means and for outputting/receiving display data to/from the display means, other address output means connected to the display means and to each of said plurality of address means for outputting said relative address data, said other address output means also being operative to output a select signal for selecting one of the plurality of address output means, and for outputting address data which is relative to the predetermined address range of the selected one of the plurality of address output means, and control means for outputting to the other address output means, a selection signal, address data and display data for writing/reading in the display space.

3. A display control circuit as in claim 1 wherein each of the row drive means includes a random access memory for receiving a selection signal, relative row and column address data from the column drive means and display data.

4. A display control circuit as in claim 2 wherein each of the plurality of address output means includes a memory device for receiving a selection signal and relative address data from the other address means and for storing data from the other address means or the display means.

5. A display control circuit for a display unit having a plurality of addressable positions arranged in a matrix, comprising:

a plurality of segment drive circuits connected to the display unit in a line writing/reading direction, each said segment drive circuit being provided for the writing/reading of data to/from only a predetermined addressing range of addressable positions of a total range of addressable positions of the matrix, said predetermined addressing range of addressable positions being in the line writing/reading direction and in an orthogonal direction, each said segment drive circuit producing a relative address within the predetermined addressing range associated with the segment drive circuit in response to address data and a selection signal input thereto for writing/reading data input thereto at/from the generated relative address;

a common drive circuit responsive to input data for driving a common electrode of the display unit and for selecting one of the segment drive circuits and providing address data for writing/reading data to/from said relative address and for providing/receiving display data only to/from the selected segment drive circuit; and a processing unit connected to the common drive unit for providing said input data including display data and address data and for receiving output data read from the display unit.

6. A display control circuit as in claim 5, wherein the common drive unit includes registers for receiving display data and for outputting displayed data to the processing unit and a memory control unit for receiving address data from the processing unit.

7. A display control circuit as in claim 6, wherein the memory control unit in response to the address data from the processing unit generates said relative address in the selected one of the plurality of segment drive circuits.

8. A display control circuit as in claim 7, wherein the control unit includes writing/reading address registers and increment/decrement circuits for providing address data to a selected one of the segment drive units.

9. A display control circuit as in claim 8 wherein the increment/decrement circuits modify the address data provided by the writing/reading address registers by 0, ±1 or ±8.

10. A display control circuit as in claim 5 wherein each of the plurality of segment drive circuits includes a random access memory for storing data for writing/reading to/from the display unit at addressable positions within the predetermined range associated with a respective segment drive circuit in response to address data, a selection signal and display data provided by the common drive circuit.

* * * * *